US010648232B2

(12) United States Patent
Colson et al.

(10) Patent No.: US 10,648,232 B2
(45) Date of Patent: May 12, 2020

(54) METHODS AND APPARATUS TO CONTROL AN ARCHITECTURAL OPENING COVERING ASSEMBLY

(71) Applicant: Hunter Douglas Inc., Pearl River, NY (US)

(72) Inventors: Wendell Colson, Weston, MA (US); Dan Fogarty, Framingham, MA (US); Paul G. Swiszcz, Niwot, CO (US); William Johnson, Milford, MA (US)

(73) Assignee: Hunter Douglas Inc., Pearl River, NY (US)

( * ) Notice: Subject to any disclaimer, the term of this patent is extended or adjusted under 35 U.S.C. 154(b) by 0 days.

(21) Appl. No.: 14/044,832

(22) Filed: Oct. 2, 2013

(65) Prior Publication Data

US 2014/0090787 A1 Apr. 3, 2014

Related U.S. Application Data

(60) Provisional application No. 61/744,756, filed on Oct. 3, 2012.

(51) Int. Cl.
*E06B 9/82* (2006.01)
*E06B 9/42* (2006.01)
(Continued)

(52) U.S. Cl.
CPC ..... *E06B 9/82* (2013.01); *E06B 9/42* (2013.01); *E06B 9/68* (2013.01); *E06B 9/72* (2013.01);
(Continued)

(58) Field of Classification Search
CPC ..... E06B 9/72; E06B 9/322; E06B 9/40
(Continued)

(56) References Cited

U.S. PATENT DOCUMENTS 2,878,865 A 3/1959 Manley
3,186,473 A 6/1965 Myers et al.
(Continued)

FOREIGN PATENT DOCUMENTS

AU 2010901077 3/2010
CN 1331945 1/2002
(Continued)

OTHER PUBLICATIONS

International Bureau, "International Preliminary Report on Patentability," issued in connection with application No. PCT/US2012/000429, dated Apr. 17, 2014, 7 pages.
(Continued)

*Primary Examiner* — Cortez M Cook
(74) *Attorney, Agent, or Firm* — Hanley, Flight & Zimmerman, LLC

(57) ABSTRACT

Methods and apparatus to control an architectural opening covering assembly are disclosed herein. An example architectural opening covering assembly includes a tube and a covering coupled to the tube such that rotation of the tube winds or unwinds the covering around the tube. A motor is operatively coupled to the tube to rotate the tube. The example architectural opening covering assembly also includes a gravitational sensor to generate tube position information based on a gravity reference. The example architectural opening covering assembly further includes a controller communicatively coupled to the motor to control the motor. The controller is to determine a position of the covering based on the tube position information.

32 Claims, 15 Drawing Sheets

(51) Int. Cl.
*E06B 9/68* (2006.01)
*E06B 9/72* (2006.01)

(52) U.S. Cl.
CPC ..... *E06B 2009/6827* (2013.01); *E06B 2009/6845* (2013.01)

(58) Field of Classification Search
USPC ..... 160/84; 318/280, 310
See application file for complete search history.

(56) References Cited

U.S. PATENT DOCUMENTS 3,521,693 A 7/1970 Kuss
3,732,914 A 5/1973 Flageollet
3,853,167 A 12/1974 Wardlaw
4,085,345 A 4/1978 Bullat
4,112,996 A 9/1978 Fühl
4,372,367 A 2/1983 Baldanello et al.
4,413,665 A 11/1983 Corcoran
4,417,185 A 11/1983 Bullat
4,472,910 A 9/1984 Iha
4,519,487 A 5/1985 Florin
4,519,554 A 5/1985 Dussoliet et al.
4,560,046 A 12/1985 Lorello et al.
4,618,804 A 10/1986 Iwasaki
4,651,940 A 3/1987 Nakamura
4,766,941 A 8/1988 Sloop et al.
4,794,715 A 1/1989 Cherwin
4,807,686 A 2/1989 Schnebly et al.
4,972,129 A 11/1990 Kawai et al.
4,979,603 A 12/1990 Wheatland
5,039,925 A 8/1991 Schap
5,105,871 A 4/1992 Baud et al.
5,547,009 A 8/1996 Plumer
5,671,387 A 9/1997 Jacobs et al.
5,709,349 A 1/1998 Villette et al.
5,794,381 A 8/1998 Rizkovsky
5,799,716 A 9/1998 Yamuguchi et al.
5,803,150 A 9/1998 Boiteau
5,839,555 A 11/1998 Hsieh
5,848,634 A 12/1998 Will et al.
5,975,185 A 11/1999 Miller et al.
6,055,885 A 5/2000 Shea
6,104,156 A 8/2000 Bruno
6,111,376 A 8/2000 Jean-Marc
6,158,563 A 12/2000 Welfonder et al.
6,244,325 B1 6/2001 Miller et al.
6,259,218 B1 7/2001 Kovach et al.
6,341,638 B1 1/2002 Thompson et al.
6,346,889 B1 2/2002 Moss
6,381,903 B1 5/2002 Desrochers et al.
6,497,267 B1 12/2002 Azar et al.
6,571,853 B1 6/2003 Ciuca et al.
6,628,029 B2 9/2003 Astegno
6,680,594 B2 1/2004 Collett et al.
6,733,413 B2 5/2004 Lagarde et al.
6,751,909 B2 7/2004 Ranaudo
6,810,997 B2 11/2004 Schreiber et al.
6,843,301 B2 1/2005 Carrillo et al.
6,843,303 B2 1/2005 Siak et al.
6,979,962 B2 12/2005 Cavarec et al.
7,089,991 B2 8/2006 Jorgensen et al.
7,134,474 B2 11/2006 Lagarde et al.
7,240,582 B1 7/2007 Manaras et al.
7,261,139 B2 8/2007 Varley et al.
D553,079 S 10/2007 Poulet et al.
7,466,090 B2 12/2008 Meewis et al.
7,481,133 B2 1/2009 Walravens et al.
7,599,612 B2 10/2009 Moseley et al.
7,726,379 B2 6/2010 Beau
7,770,961 B2 8/2010 Oxley
7,839,109 B2 11/2010 Carmen et al.
8,037,922 B2 10/2011 Hawkins et al.
8,125,167 B1 2/2012 Mullet et al.
8,299,734 B2 10/2012 Mullet et al.
8,339,086 B2 12/2012 Feldstein et al.
8,368,328 B2 2/2013 Mullet et al.
8,575,872 B2 11/2013 Mullet et al.
8,659,246 B2 2/2014 Mullet et al.
8,662,139 B2 3/2014 Anthony et al.
8,723,454 B2 5/2014 Skinner et al.
8,791,658 B2 7/2014 Mullet et al.
8,910,695 B2 12/2014 Knight
8,931,541 B2 1/2015 Chambers et al.
8,947,027 B2 2/2015 Mullet et al.
9,018,868 B2 4/2015 Lucas et al.
9,152,032 B2 10/2015 Mullet et al.
9,181,750 B2 11/2015 Ticoalu et al.
9,194,179 B2 11/2015 Mullet et al.
9,249,623 B2 2/2016 Mullet et al.
9,376,862 B2 6/2016 Mullet et al.
9,376,863 B2 6/2016 Mullet et al.
9,394,743 B2 7/2016 Mullet et al.
9,410,369 B2 8/2016 Mullet et al.
9,611,690 B2 4/2017 Mullet et al.
9,725,948 B2 8/2017 Mullet et al.
9,725,952 B2 8/2017 Mullet et al.
9,745,797 B2 8/2017 Mullet et al.
9,765,568 B2 9/2017 Colson et al.
9,771,755 B2 9/2017 Mullet et al.
9,890,585 B2 2/2018 Mullet et al.
9,896,882 B2 2/2018 Mullet et al.
10,246,938 B2 4/2019 Mullet et al.
2002/0011262 A1 1/2002 Dieckmann
2002/0153854 A1 10/2002 Reed et al.
2002/0190678 A1* 12/2002 Huber ..... E06B 9/32 318/434
2004/0011477 A1 1/2004 Walker et al.
2004/0169490 A1 9/2004 Heurtault
2004/0169940 A1 9/2004 Yoshida
2005/0035238 A1 2/2005 Fun
2005/0051283 A1 3/2005 Chatellard et al.
2005/0173080 A1 8/2005 Carmen, Jr. et al.
2005/0253710 A1 11/2005 Eskildsen
2006/0042763 A1 3/2006 Le Ru
2006/0042765 A1* 3/2006 Varley ..... E06B 9/76 160/310
2006/0086874 A1 4/2006 Habel et al.
2006/0243401 A1 11/2006 Chen
2007/0000622 A1* 1/2007 Reed et al. ..... 160/188
2008/0052034 A1 2/2008 David et al.
2008/0111511 A1* 5/2008 Kang ..... B60L 15/20 318/461
2008/0283200 A1 11/2008 Hummel et al.
2009/0005911 A1 1/2009 Decroix et al.
2009/0256021 A1 10/2009 Dorrough
2010/0006240 A1 1/2010 Cieslik
2010/0018654 A1* 1/2010 Skinner ..... E06B 9/322 160/84.02
2010/0191409 A1* 7/2010 Weston ..... B60C 23/009 701/29.6
2010/0200176 A1 8/2010 Magli
2010/0236891 A1 9/2010 Lagarde et al.
2010/0244602 A1 9/2010 Perret et al.
2010/0279779 A1 11/2010 Anthoine
2011/0048655 A1* 3/2011 Andreasen ..... E06B 9/72 160/310
2011/0073262 A1 3/2011 Frede
2011/0139380 A1 6/2011 Anthony et al.
2011/0203748 A1* 8/2011 Mullet ..... E06B 9/42 160/310
2011/0203754 A1 8/2011 Mullet et al.
2012/0200247 A1 8/2012 Baugh
2013/0140130 A1 6/2013 Dang
2013/0199735 A1 8/2013 Colson et al.
2014/0133019 A1 5/2014 Mullet et al.
2014/0224437 A1 8/2014 Colson et al.
2014/0262058 A1 9/2014 Mullet et al.
2014/0262078 A1 9/2014 Colson et al.
2014/0290870 A1 10/2014 Colson et al.
2015/0090409 A1 4/2015 Mullet et al.

(56) References Cited

U.S. PATENT DOCUMENTS

FOREIGN PATENT DOCUMENTS

| | | | |
|---|---|---|---|
| CN | 2823518 | | 10/2006 |
| CN | 1981311 | | 6/2007 |
| CN | 201202392 | | 3/2009 |
| CN | 201943550 | | 8/2011 |
| CN | 102333469 | | 1/2012 |
| DE | 29818023 | | 12/1998 |
| DE | 202011051106 | | 9/2011 |
| EP | 0783072 | A1 | 7/1997 |
| EP | 0838574 | | 4/1998 |
| EP | 0940553 | A2 | 9/1999 |
| EP | 1659256 | | 5/2006 |
| EP | 2192249 | | 6/2010 |
| JP | 59230942 | | 12/1984 |
| JP | 622797 | | 1/1987 |
| JP | 253496 | | 4/1990 |
| JP | 74774 | | 1/1995 |
| JP | 08199950 | | 8/1996 |
| JP | H1046961 | | 2/1998 |
| JP | 2002070465 | | 3/2002 |
| JP | 2004190476 | | 7/2004 |
| JP | 2004237362 | | 8/2004 |
| JP | 20062531 | | 1/2006 |
| JP | 2006233418 | | 9/2006 |
| WO | WO0241740 | | 5/2002 |
| WO | 2010011751 | A1 | 1/2010 |
| WO | 2011106397 | | 9/2011 |
| WO | 2011106398 | | 9/2011 |
| WO | 2011113094 | | 9/2011 |
| WO | 2013059037 | | 4/2013 |
| WO | 2014062504 | | 4/2014 |
| WO | 2014169173 | | 10/2014 |

OTHER PUBLICATIONS

International Bureau, "International Preliminary Report on Patentability," issued in connection with application No. PCT/US2012/000428, dated Apr. 17, 2014, 8 pages.
International Searching Authority, "International Search Report and Written Opinion of the International Searching Authority," issued in connection with application No. PCT/US2014/028534, dated Aug. 5, 2014, 11 pages.
European Patent Office, "Extended European Search Report," issued in connection with application No. EP 13186952.1, dated Jan. 9, 2015, 9 pages.
United States Patent and Trademark Office, "Final Office Action," issued in connection with U.S. Appl. No. 14/349,629, dated Jun. 27, 2016, 44 pages.
Patent Cooperation Treaty, "International Search Report," issued in connection with Application No. PCT/US2012/000429, dated Dec. 17, 2012, 3 pages.
Patent Cooperation Treaty, "Written Opinion of the International Searching Authority," issued in connection with Application No. PCT/US2012/000429, dated Dec. 17, 2012, 5 pages.
Patent Cooperation Treaty, "International Search Report," issued in connection with Application No. PCT/US2012/000428, dated Dec. 21, 2012, 3 pages.
Patent Cooperation Treaty, "Written Opinion of the International Searching Authority," issued in connection with Application No. PCT/US2012/000428, dated Dec. 21, 2012, 6 pages.
Patent Cooperation Treaty, "International Preliminary Report on Patentability," issued in connection with Application No. PCT/US2011/038469, dated Dec. 13, 2012, 10 pages.
Patent Cooperation Treaty, "International Search Report," issued in connection with Application No. PCT/US2011/038469, dated Sep. 23, 2011, 4 pages.
Patent Cooperation Treaty, "Written Opinion of the International Searching Authority," issued in connection with Application No. PCT/US2011/038469, dated Sep. 23, 2011, 7 pages.
United States Patent and Trademark Office, "Final Office Action," issued in connection with U.S. Appl. No. 12/816,152, dated Jul. 9, 2013, 7 pages.
United States Patent and Trademark Office, "Non-Final Office Action" issued in connection with U.S. Appl. No. 12/816,152, dated Nov. 20, 2012, 11 pages.
United States Patent and Trademark Office, "Non-Final Office Action," issued in connection with U.S. Appl. No. 12/816,152, dated May 31, 2012, 13 pages.
United States Patent and Trademark Office, "Non-Final Office Action," issued in connection with U.S. Appl. No. 13/367,000, dated Sep. 18, 2014, 28 pages.
United States Patent and Trademark Office, "Notice of Allowance," issued in connection with U.S. Appl. No. 12/816,152, dated Oct. 23, 2013, 18 pages.
United States Patent and Trademark Office, "Non-Final Office Action" issued in connection with U.S. Appl. No. 14/349,628 dated Jun. 2, 2015, 85 Pages.
Japanese Patent Office, "Office Action," issued in connection with application No. 2013-512066 dated Apr. 21, 2015, 7 pages.
State Intellectual Property Office, "Search Report with English Translation", issued in connection with application No. 2012800520005 dated Apr. 20, 2015, 2 pages.
United States Patent and Trademark Office, "Non-Final Office Action," issued in connection with U.S. Appl. No. 13/699,580, dated Jul. 2, 2015, 32 pages.
United States Patent and Trademark Office, "Restriction Requirement," issued in connection with U.S. Appl. No. 14/349,629, dated Jul. 31, 2015, 10 pages.
Somfy, "Motor Catalog" , Sonfy Systems, Inc., Dec. 2013, http://www.usautomated.com/vendors/catalogs/somfy/Motor_Catalog.pdf, 78 pages.
Somfy, "Motor for Awnings", Somfy LT CSI WT—Automatic manual over-ride, http://www.somfy.co.uk/product/en-uk/lt-csi-wt/1440.cfm?channel=pro, retrieved on Nov. 22, 2010, 1 page.
Somfy, "The Motor With Back-Up Operation for Terrace Awnings", http://www.somfy.co.uk/product/en-uk/lt-csi-rts/1439.cfm?channel=pro, retrieved on Nov. 22, 2010, 1 page.
Somfy, "Sunea RTS CMO Universal Performance", Somfy Systems, Inc. North America Headquarters, Aug. 2009, 2 pages.
Somfy, "Sunea RTS CMO (Compact Manual Override)", Somfy Systems Inc., Feb. 2015, 1 page.
Patent Cooperation Treaty, "International Preliminary Report on Patentability", issued in connection with international application No. PCT/US2014/028534, dated Sep. 15, 2015, 6 pages.
United States Patent and Trademark Office, "Non-Final Office Action," issued in connection with U.S. Appl. No. 14/349,629, dated Dec. 17, 2015, 51 pages.
United States Patent and Trademark Office, "Notice of Allowance," issued in connection with U.S. Appl. No. 14/349,628, dated Jan. 6, 2016, 48 pages.
United States Patent and Trademark Office, "Final Office Action," issued in connection with U.S. Appl. No. 13/699,580, dated Mar. 11, 2016, 40 pages.
United States Patent and Trademark Office, "Non-Final Office Action," issued in connection with U.S. Appl. No. 13/699,580, dated Nov. 16, 2016, 24 pages.
United States Patent and Trademark Office, "Non-Final Office Action," issued in connection with U.S. Appl. No. 14/349,629, dated Nov. 1, 2016, 47 pages.
Colombian Patent Office, "Office Action," issued in connection with Colombian Patent Application No. 14-093599, dated Nov. 12, 2016, 21 pages (machine translation included).
United States Patent and Trademark Office, "Notice of Allowance," issued in connection with U.S. Appl. No. 13/699,580, dated Jun. 13, 2017, 21 pages.
United States Patent and Trademark Office, "Notice of Allowance," issued in connection with U.S. Appl. No. 14/349,629, dated May 16, 2017, 83 pages.
United States Patent and Trademark Office, "Non-Final Office Action," issued in connection with U.S. Appl. No. 15/133,050, dated Mar. 9, 2018, 9 pages.

* cited by examiner

METHODS AND APPARATUS TO CONTROL AN ARCHITECTURAL OPENING COVERING ASSEMBLY

RELATED APPLICATION

This patent claims the benefit of U.S. Provisional Application Ser. No. 61/744,756, titled "Methods and Apparatus to Control an Architectural Opening Covering Assembly," filed Oct. 3, 2012, which is hereby incorporated by reference herein in its entirety.

FIELD OF THE DISCLOSURE

This disclosure relates generally to architectural opening covering assemblies and, more particularly, to methods and apparatus to control an architectural opening covering assembly.

BACKGROUND

Architectural opening covering assemblies such as roller blinds provide shading and privacy. Such assemblies generally include a motorized roller tube connected to covering fabric or other shading material. As the roller tube rotates, the fabric winds or unwinds around the tube to uncover or cover an architectural opening.

Figure 1:
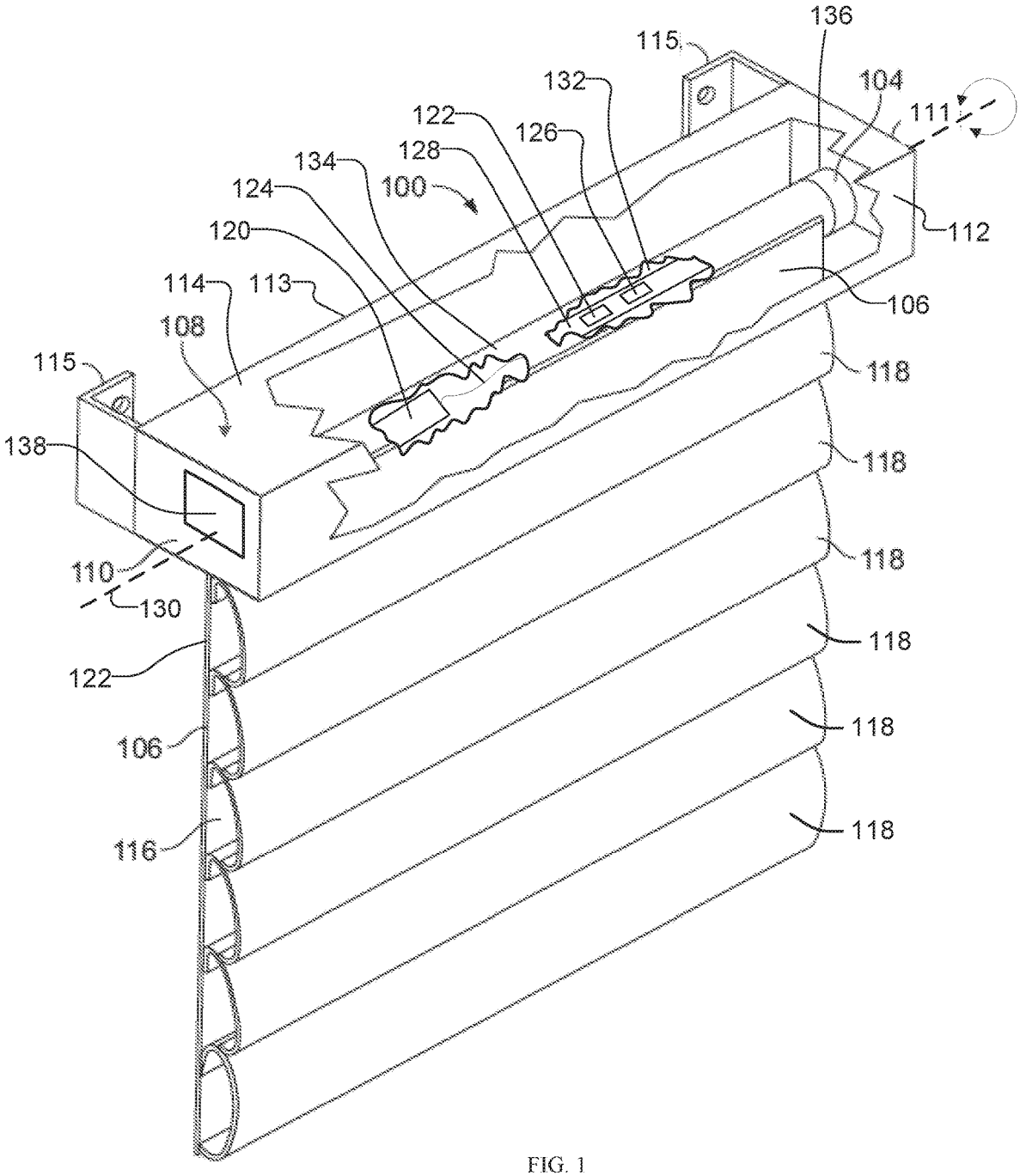
FIG. 1 is an isometric illustration of an example architectural opening covering assembly constructed in accordance with the teachings of this disclosure.

Wherever possible, the same reference numbers will be used throughout the drawing(s) and accompanying written description to refer to the same or like parts. As used in this patent, stating that any part (e.g., an object, a layer, structure, area, plate, etc.) is in any way positioned on (e.g., positioned on, located on, disposed on, or formed on, etc.) another part, means that the referenced part is either in contact with the other part, or that the referenced part is above the other part relative to Earth with one or more intermediate part(s) located therebetween. Stating that any part is in contact with another part means that there is no intermediate part between the two parts.

DETAILED DESCRIPTION

An example architectural opening covering assembly disclosed herein includes a tube and a covering coupled to the tube such that rotation of the tube winds or unwinds the covering around the tube. The example architectural opening covering assembly also includes a motor operatively coupled to the tube to rotate the tube and a gravitational sensor to generate tube position information based on a gravity reference. The example architectural opening covering assembly further includes a controller communicatively coupled to the motor to control the motor. The example controller is to determine a position of the covering based on the tube position information.

An example tangible computer readable storage medium disclosed herein includes instructions that, when executed, cause a machine to at least determine an angular position of a tube of an architectural opening covering assembly via a gravitational sensor. Rotation of the example tube is to lower or raise an architectural opening covering. The example tangible computer readable storage medium further includes instructions that, when executed, cause the machine to determine a position of the architectural opening covering based on the angular position of the tube.

Another example tangible computer readable storage medium disclosed herein includes instructions that, when executed, cause a machine to at least operate a motor to rotate a tube of an architectural opening covering assembly including an architectural opening covering coupled to the tube such that rotation of the tube winds or unwinds the architectural opening covering around the tube. The example tangible computer readable storage medium further includes instructions that, when executed, cause the machine determine angular positions of the tube via a gravitational sensor while the motor is being operated and determine an angular position of the tube at which the architectural opening covering is substantially fully unwound.

An example architectural opening covering assembly disclosed herein may be controlled by a controller. In some examples, the example architectural opening covering assembly includes a motor and gravitational sensor communicatively coupled to the controller. The motor rotates a tube about which a covering is at least partially wound. Thus, if the motor rotates the tube, the covering is raised or lowered.

In some examples, the gravitational sensor generates tube position information and/or determines an angular position of the tube based on gravity (e.g., determining an angular position relative to a gravitational field vector of Earth). In some examples, by determining a number of rotations of the tube from a predetermined position (e.g., a fully unwound position, a fully wound position, etc.), the position of the covering is determined.

In some examples, the gravitational sensor is an accelerometer (e.g., a capacitive accelerometer, a piezoelectric accelerometer, a piezoresistive accelerometer, a Hall Effect accelerometer, a magnetoresistive accelerometer, a heat transfer accelerometer and/or any other suitable type of accelerometer). Other examples employ other types of gravitational sensors such as, for example, a tilt sensor, a level sensor, a gyroscope, an eccentric weight (e.g., a pendulum) movably coupled to a rotary encoder, an inclinometer, and/or any other suitable gravitational sensor.

In some examples, the gravitational sensor is used to determine if a manual input (e.g., a force such as a pull applied to the covering or any other part of the assembly) is provided. In some instances, in response to the manual input, the example controller controls the motor to move the covering, stop movement of the covering, and/or counter the manual input to prevent lowering or raising the covering past a threshold position such as, for example, a lower limit position or an upper limit position.

FIG. 1 is an isometric illustration of an example architectural opening covering assembly 100. In the example of FIG. 1, the covering assembly 100 includes a headrail 108. The headrail 108 is a housing having opposed end caps 110, 111 joined by front 112, back 113 and top sides 114 to form an open bottom enclosure. The headrail 108 also has mounts 115 for coupling the headrail 108 to a structure above an architectural opening such as a wall via mechanical fasteners such as screws, bolts, etc. A roller tube 104 is disposed between the end caps 110, 111. Although a particular example of a headrail 108 is shown in FIG. 1, many different types and styles of headrails exist and could be employed in place of the example headrail 108 of FIG. 1. Indeed, if the aesthetic effect of the headrail 108 is not desired, it can be eliminated in favor of mounting brackets.

In the example illustrated in FIG. 1, the architectural opening covering assembly 100 includes a covering 106, which is a cellular type of shade. In this example, the cellular covering 106 includes a unitary flexible fabric (referred to herein as a "backplane") 116 and a plurality of cell sheets 118 that are secured to the backplane 116 to form a series of cells. The cell sheets 118 may be secured to the backplane 116 using any desired fastening approach such as adhesive attachment, sonic welding, weaving, stitching, etc. The covering 106 shown in FIG. 1 can be replaced by any other type of covering including, for instance, single sheet shades, blinds, other cellular coverings, and/or any other type of covering. In the illustrated example, the covering 106 has an upper edge mounted to the roller tube 104 and a lower, free edge. The upper edge of the example covering 106 is coupled to the roller tube 104 via a chemical fastener (e.g., glue) and/or one or more mechanical fasteners (e.g., rivets, tape, staples, tacks, etc.). The covering 106 is movable between a raised position and a lowered position (illustratively, the position shown in FIG. 1). When in the raised position, the covering 106 is wound about the roller tube 104.

The example architectural opening covering assembly 100 is provided with a motor 120 to move the covering 106 between the raised and lowered positions. The example motor 120 is controlled by a controller 122. In the illustrated example, the controller 122 and the motor 120 are disposed inside the tube 104 and communicatively coupled via a wire 124. Alternatively, the controller 122 and/or the motor 120 may be disposed outside of the tube 104 (e.g., mounted to the headrail 108, mounted to the mounts 115, located in a central facility location, etc.) and/or communicatively coupled via a wireless communication channel.

The example architectural opening covering assembly 100 of FIG. 1 includes a gravitational sensor 126 (e.g., the gravitational sensor made by Kionix® as part number KXTC9-2050) communicatively coupled to the controller 122. The example gravitational sensor 126 of FIG. 1 is coupled to the tube 104 via a mount 128 to rotate with the tube 104. In the illustrated example, the gravitational sensor 126 is disposed inside the tube 104 along an axis of rotation 130 of the tube 104 such that an axis of rotation of the gravitational sensor 126 is substantially coaxial to the axis of rotation 130 of the tube 104. In the illustrated example, a central axis of the tube 104 is substantially coaxial to the axis of rotation 130 of the tube 104, and a center of the gravitational sensor 126 is on (e.g., substantially coincident with) the axis of rotation 130 of the tube 104. In other examples, the gravitational sensor 126 is disposed in other locations such as, for example, on an interior surface 132 of the tube 104, on an exterior surface 134 of the tube 104, on an end 136 of the tube 104, on the covering 106, and/or any other suitable location. As described in greater detail below, the example gravitational sensor 126 generates tube position information, which is used by the controller 122 to determine an angular position of the tube 104 and/or monitor movement of the tube 104 and, thus, the covering 106.

In some examples, the architectural opening covering assembly 100 is operatively coupled to an input device 138, which may be used to selectively move the covering 106 between the raised and lowered positions. In some examples, the input device 138 sends a signal to the controller 122 to enter a programming mode in which one or more positions (e.g., a lower limit position, an upper limit position, a position between the lower limit position and the upper limit position, etc.) are determined and/or recorded. In the case of an electronic signal, the signal may be sent via a wired or wireless connection.

In some examples, the input device 138 is a mechanical input device such as, for example, a cord, a lever, a crank, and/or an actuator coupled to the motor 120 and/or the tube 104 to apply a force to the tube 104 to rotate the tube 104. In some examples, the input device 128 is implemented by the covering 106 and, thus, the input device 138 is eliminated. In some examples, the input device 138 is an electronic input device such as, for example, a switch, a light sensor, a computer, a central controller, a smartphone, and/or any other device capable of providing instructions to the motor 120 and/or the controller 122 to raise or lower the covering 106. In some examples, the input device 138 is a remote control, a smart phone, a laptop, and/or any other portable communication device, and the controller 122 includes a receiver to receive signals from the input device 138. Some example architectural opening covering assemblies include other numbers of input devices (e.g., 0, 2, etc.). The example architectural opening covering assembly 100 may include any number and combination of input devices. Example architectural opening covering assemblies that can be used to implement the example architectural opening covering assembly 100 of FIG. 1 are described in International Application No. PCT/US2012/000428, titled "Methods and Apparatus to Control Architectural Opening Covering Assemblies," filed Oct. 3, 2012, which is hereby incorporated by reference herein in its entirety.

Figure 2:
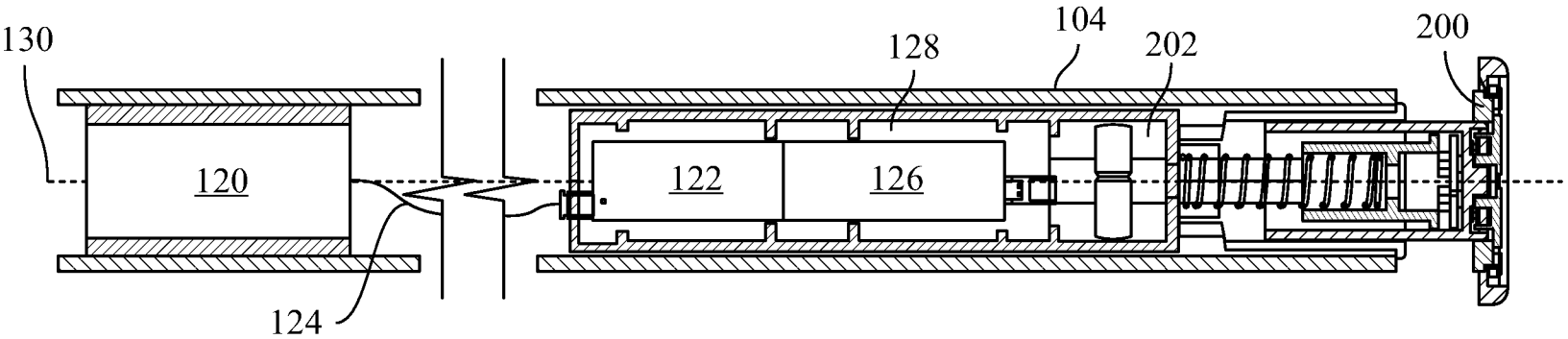
FIG. 2 is a cross-sectional view of a tube of the example architectural opening covering assembly of FIG. 1.

FIG. 2 is a cross-sectional view of the example tube 104 of FIG. 1. In the illustrated example, the tube 104 is coupled to the end cap 111 and/or the mount 115 via a slip ring 200. In some examples, a power source provides power to the input device 138, the motor 120, the controller 122, and/or other components of the architectural opening covering assembly 100 via the slip ring 200. A housing 202 is disposed inside the example tube 104 of FIG. 2 to rotate with the tube 104. In the illustrated example, the mount 128 is disposed inside the housing 202 and is coupled to the housing 202. The example mount 128 of FIG. 2 is a circuit board (e.g., a printed circuit board (PCB)) onto which components of the controller 122 are coupled. Thus, in the illustrated example, the controller 122 and the gravitational sensor 126 rotate with the tube 104.

As mentioned above, the example gravitational sensor 126 is coupled to the mount 128 such that an axis of rotation of the gravitational sensor 126 is substantially coaxial to the axis of rotation 130 of the tube 104, which is substantially coaxial to a central axis of the tube. In the illustrated example, the center of the gravitational sensor 126 is disposed on (e.g., substantially coincident with) the axis of rotation 130 of the tube 104. As a result, when the tube 104 rotates about the axis of rotation 130, the gravitational sensor 126 is subjected to a substantially constant gravitational force (g-force) of about 1 g (i.e., the gravitational sensor 126 does not substantially move up and down relative to Earth). In other examples, the gravitational sensor 126 is disposed in other positions and experiences variable g-forces as the tube 104 rotates. As described below, the g-force provides a frame of reference independent of the angular position of the tube 104 from which the rotation and, thereby, an angular position of the tube 104 can be determined.

In the illustrated example, the gravitational sensor 126 is an accelerometer (e.g., a capacitive accelerometer, a piezoelectric accelerometer, a piezoresistive accelerometer, a Hall Effect accelerometer, a magnetoresistive accelerometer, a heat transfer accelerometer and/or any other suitable type of accelerometer). Alternatively, the gravitational sensor 126 may be any other type of gravitational sensor such as, for example, a tilt sensor, a level sensor, a gyroscope, an eccentric weight (e.g., a pendulum) movably coupled to a rotary encoder, an inclinometer, and/or any other suitable gravitational sensor.

Alternatively, any other sensor that determines the angular position of the tube 104 relative to one or more frame(s) of references that are independent of (e.g., substantially fixed or constant relative to) the angular position of the tube 104 may be utilized. For example, a sensor that generates tube position information based a magnetic field imparted by one or more magnets disposed outside of the tube 104 (e.g., on a wall, bracket, etc. adjacent the tube 104) may be employed by the example architectural opening covering assembly 100. Similarly, a sensor may generate tube position information based on a radio frequency (RF) signal transmitted from outside of the tube 104 (e.g., by detecting a strength of the RF signal, which may vary depending on the angular position of the sensor in and/or on the tube 104 relative to a RF signal transmitter, and so forth.

Figure 15A:
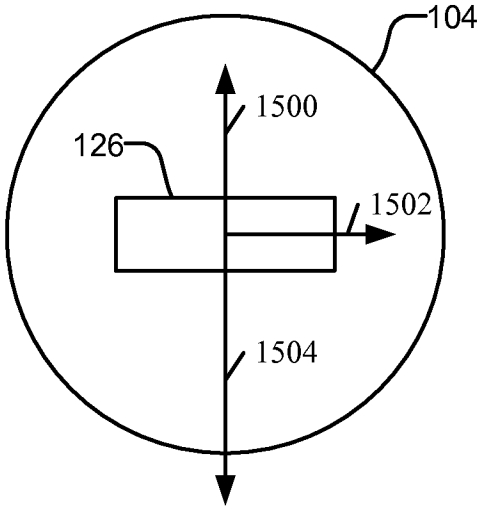
FIG. 15A-C illustrates angular positions of the tube of the example architectural opening covering assembly of FIGS. 1-2.
Figure 15B:
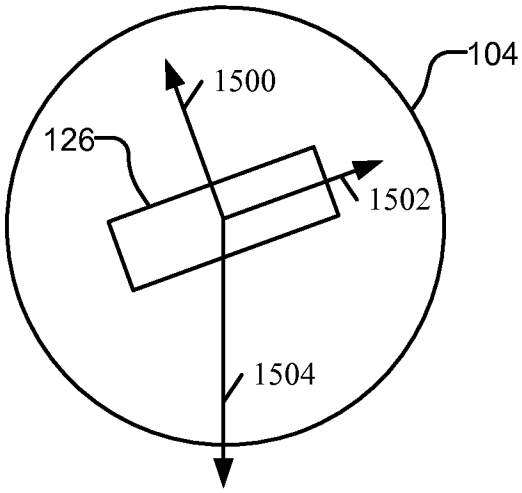
Figure 15C:
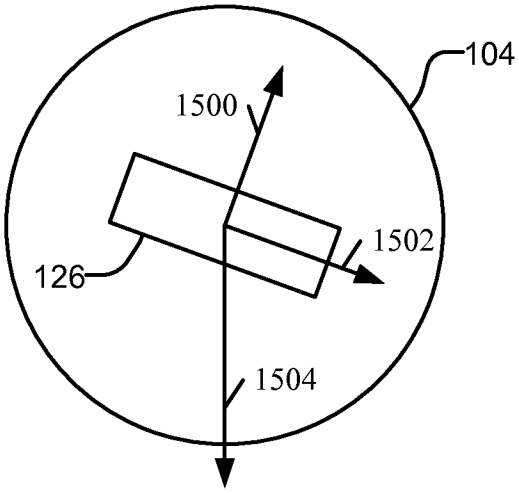

FIGS. 15A-C illustrate the example tube 104 and the example gravitational sensor 126 oriented in various angular positions. In the illustrated example, the gravitational sensor 126 is a dual-axis gravitational sensor. Thus, the gravitational sensor 126 generates tube position information based on an orientation of a first axis 1500 and a second axis 1502 of the gravitational sensor 126 relative to a direction of gravitational force, which is illustrated in FIGS. 15A-C as a gravitational vector of Earth 1504. In the illustrated example, the axis of rotation 130 of the tube 104 runs perpendicular to the plane in which FIGS. 15A-C are drawn. The example first axis 1500 and the example second axis 1502 of FIGS. 15A-C are perpendicular to each other and the axis of rotation 130 of the tube 104. As a result, when the first axis 1500 is aligned with the gravitational field vector of Earth 1504, as illustrated in FIG. 15A, the second axis 1502 is perpendicular to the gravitational field vector of Earth 1504. Alternatively, the gravitational sensor 126 may be a tri-axial gravitational sensor and/or any other type of gravitational sensor.

The gravitational sensor 126 of the illustrated example generates tube position information and transmits the tube position information to the controller 122. The example gravitational sensor 126 outputs a first signal associated with the first axis 1500 and a second signal associated with the second axis 1502. The first signal includes a first value (e.g., a voltage) corresponding to a g-force experienced by the gravitational sensor 126 along the first axis 1500. The second signal includes a second value (e.g., a voltage) corresponding to a g-force experienced by the gravitational sensor 126 along the second axis 1502. Thus, the tube position information generated by the example gravitational sensor 126 includes the first value and the second value, which are based on the orientation of the gravitational sensor 126. In the illustrated example, the gravitational sensor 126 substantially constantly outputs the first signal and/or the second signal. In some examples, the gravitational sensor 126 outputs the first signal and the second signal according to a schedule (e.g., the gravitational sensor 126 outputs the first signal and/or the second signal every one one-hundredth of a second irrespective of the detection of movement, etc.).

Each angular position of the gravitational sensor 126 and, thus, the tube 104 corresponds to a different first value and/or second value. Thus, the first value and/or the second value are indicative of an angular displacement of the gravitational sensor 126 relative to the gravitational field vector of Earth 1504. A combination of the first value and the second value is indicative of a direction of the angular displacement (e.g., clockwise or counterclockwise) of the example gravitational sensor 126 relative to the gravitational vector of Earth 1504. As a result, based on the first value and the second value, an angular position (i.e., the amount of angular displacement in a given direction relative to the gravitational vector of Earth 1504) of the tube 104 may be determined. A change in the first value and/or the second value is indicative of motion (i.e., rotation) of the tube 104. Thus, a rate of change of the first value and/or the second value is indicative of a speed of rotation of the tube 104, and a rate of change of the speed of rotation of the tube 104 indicates an angular acceleration of the tube 104.

In the illustrated example of FIG. 15A, the gravitational sensor 126 is in a first angular position such that the first axis 1500 is aligned with the gravitational field vector 1504 and pointing in an opposite direction of the gravitational field vector 1504. As a result, the example gravitational sensor 126 outputs a first value corresponding to positive 1 g. In the illustrated example of FIG. 15A, the second axis 1502 is perpendicular to the gravitational field vector 1502 and, thus, the gravitational sensor 126 outputs a second value corresponding to zero g.

In the illustrated example of FIG. 15B, the gravitational sensor is in a second angular position such that the gravitational sensor 126 is rotated about 30 degrees counterclockwise in the orientation of FIG. 15B from the first angular position. The first value and the second value output by the example gravitational sensor 126 are sinusoidal functions of the angular position of the gravitational sensor 126 relative to the gravitational vector of Earth 1504. Thus, in the illustrated example, one or more trigonometric functions may be used to determine the angular position of the gravitational sensor 126 based on the first value and the second value. In the illustrated example of FIG. 15B, when the gravitational sensor 126 is in the second position, the gravitational sensor 126 outputs the first value indicative of 0.866 g (0.866 g=1 g×sin(60 degrees)) and the second value indicative of about 0.5 g (0.5 g=1 g×sin(30 degrees). Thus, an inverse tangent of the g-force indicated by the first value over the g-force indicated by the second value indicates that the second angular position of the gravitational sensor 126 and, thus, the tube 104 is thirty degrees counterclockwise from the first angular position.

In FIG. 15C, the tube 104 is in a third angular position at which the tube 104 is rotated thirty degrees clockwise in the orientation of FIG. 15C from the first angular position. As a result, the first value indicates a g-force of positive 0.866 g and the second value indicates a g-force of negative 0.5 g. Thus, the inverse tangent of the g-force indicated by the first value over the g-force indicated by the second value indicates that the tube 104 is rotated thirty degrees clockwise from the first angular position.

As the tube 104 and, thus, the gravitational sensor 126 rotate about the axis of rotation 130, the first value and the second value of the first signal and the second signal, respectively, change according to the orientation (e.g., angular position) of the gravitational sensor 126. Thus, rotation of the tube 104 may be determined by detecting a change in the first value and/or the second value. Further, the angular displacement (i.e., amount of rotation) of the tube 104 may be determined based on the amount of change of the first value and/or the second value.

The direction of the angular displacement may be determined based on how the first value and/or the second value change (e.g., increase and/or decrease). For example, if the g-force experienced along the first axis decrease and the g-force experienced along the second axis decrease, the tube 104 is rotating counterclockwise in the orientation of FIG. 1. While particular units and directions are disclosed as examples herein, any units and/or directions may be utilized. For example, an orientation that results in a positive value in an example disclosed herein may alternatively result in a negative value in a different example.

A revolution of the tube 104 may be determined and/or incremented by detecting a repetition of a combination of the first value and the second value during rotation of the tube 104. For example, if the tube 104 is rotating in one direction and a given combination of the first value and the second value repeat (e.g., a combination indicative of 1 g and 0 g for the first value and the second value, respectively), the tube 104 rotated one revolution from the angular position at which the combination of the first and second value corresponds (e.g., the first angular position).

In some examples, a rotational speed of the tube 104 is determined based on a rate of change of the angular position of the gravitational sensor 126. In some examples, the controller 122 determines the angular position of the tube 104, the rotational speed of the tube 104, the direction of rotation of the tube 104 and/or other information based on the tube position information generated by the gravitational sensor 126. In other examples, the tube position information includes the angular position of the tube 104, the rotational speed of the tube 104, and/or other information.

Based on the angular displacement (e.g., a number of revolutions) of the tube 104 from a reference position of the covering 106 (e.g., a previously stored position, a fully unwound position, a lower limit position, an upper limit position, etc.), a position of the covering 106 may be determined, monitored and/or recorded.

During operation of the example architectural opening covering assembly 100, the example gravitational sensor 126 transmits tube position information to the controller 122. In some examples, the controller 122 receives a command from the input device 138 to move the covering 106 in a commanded direction (e.g., to raise the covering 106, to lower the covering 106, etc.) and/or move the covering 106 to a commanded position (e.g., a lower limit position, an upper limit position, etc.). In some examples, based on the tube position information, the controller 122 determines a direction in which the tube 104 is to be rotated to move the covering 106 in the commanded direction, a number of (and/or a fraction of) revolutions of the tube 106 to move the covering 106 from its current position to the commanded position, and/or other information. The example controller 122 then transmits a signal to the motor 120 to rotate the tube 104 in accordance with the command. As the motor 120 rotates the tube 104 and winds or unwinds the covering 106, the gravitational sensor 126 transmits tube position information to the controller 122, and the controller 122 determines, monitors and/or stores the position of the covering 106, the number of revolutions of the tube 104 (which may be whole numbers and/or fractions) away from the commanded position and/or a reference position, and/or other information. Thus, the controller 122 controls the position of the covering 106 based on the tube position information generated by the example gravitational sensor 126.

In some examples, the user provides a user input that causes the tube 104 to rotate or rotate at a speed greater than or less than one or more thresholds of rotational speed of the tube 104 expected via operation of the motor 120 (e.g., by pulling on the covering 106, twisting the tube 104, etc.). In some examples, based on the tube position information generated by the example gravitational sensor 126, the controller 122 monitors movement of the tube 104 and detects the user input (e.g., based on detecting movement of the tube 104 (e.g., a rock and/or rotation, an angular acceleration, a deceleration, etc.) when the motor 120 is not being operated to move the tube 104). When the user input is detected, the controller 122 may operate the motor 120 (e.g., to counter or assist rotation of the tube 104).

Figure 3:
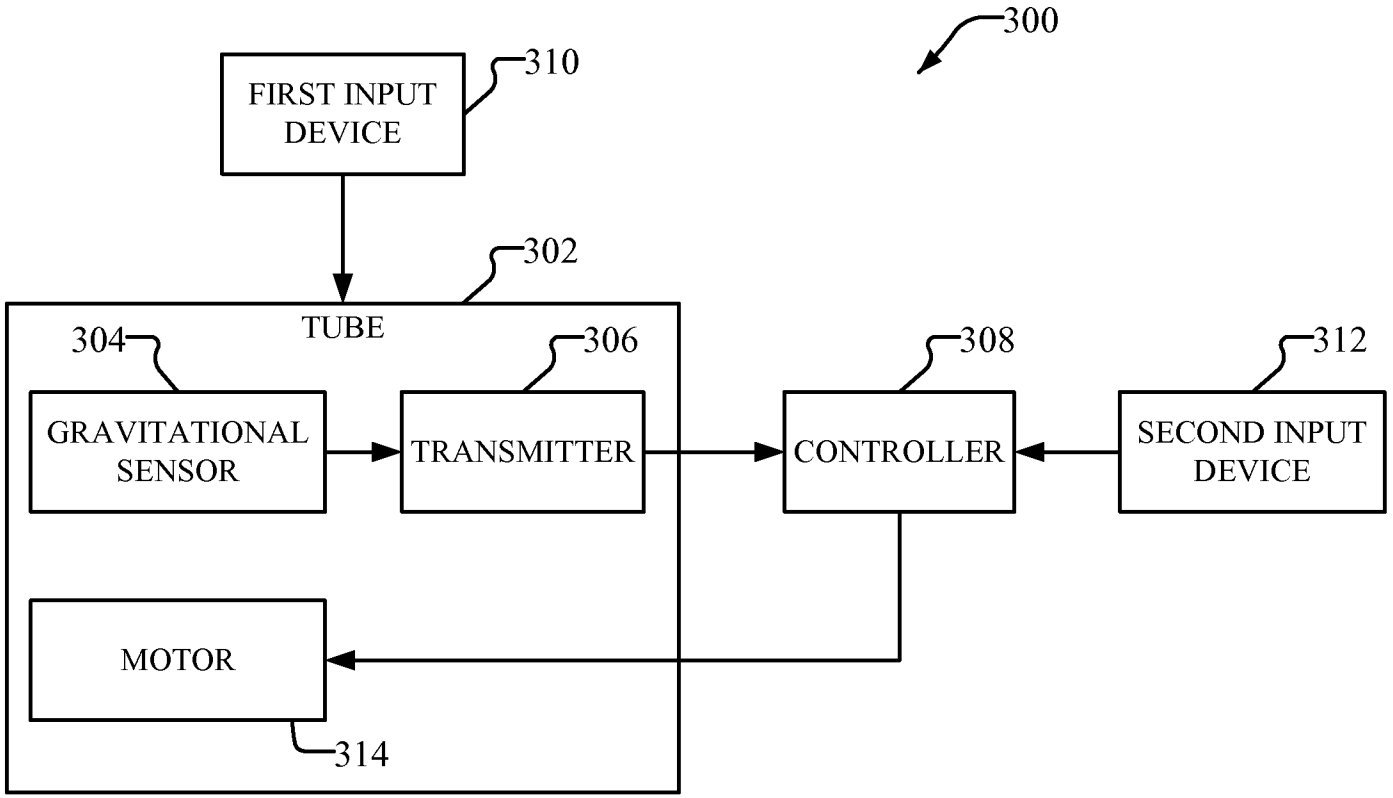
FIG. 3 is a block diagram representative of another example architectural opening covering assembly disclosed herein.

FIG. 3 is a block diagram of another example architectural opening covering assembly 300 disclosed herein. In the illustrated example, the architectural opening covering assembly 300 includes a tube 302, a gravitational sensor 304, a transmitter 306, a controller 308, a first input device 310, a second input device 312 and a motor 314. In the illustrated example, the gravitational sensor 304, the transmitter 306 and the motor 314 are disposed inside the tube 302. The example controller 308 of FIG. 3 is disposed outside of the tube 302 (e.g., in a control box adjacent an architectural opening). In the illustrated example, the first input device 310 is a mechanical input device (e.g., a cord (e.g., a loop) drivable actuator) operatively coupled to the tube 302. The example second input device 312 is an electronic input device (e.g., a remote control) communicatively coupled to the controller 308. During operation of the example architectural opening covering assembly 300, the gravitational sensor 304 generates tube position information, and the transmitter 306 transmits the tube position information to the controller 308 (e.g., wirelessly, via a wire, etc.). The example controller 308 utilizes the tube position information to monitor a position of the tube 302 and operate the motor 314.

Figure 4:
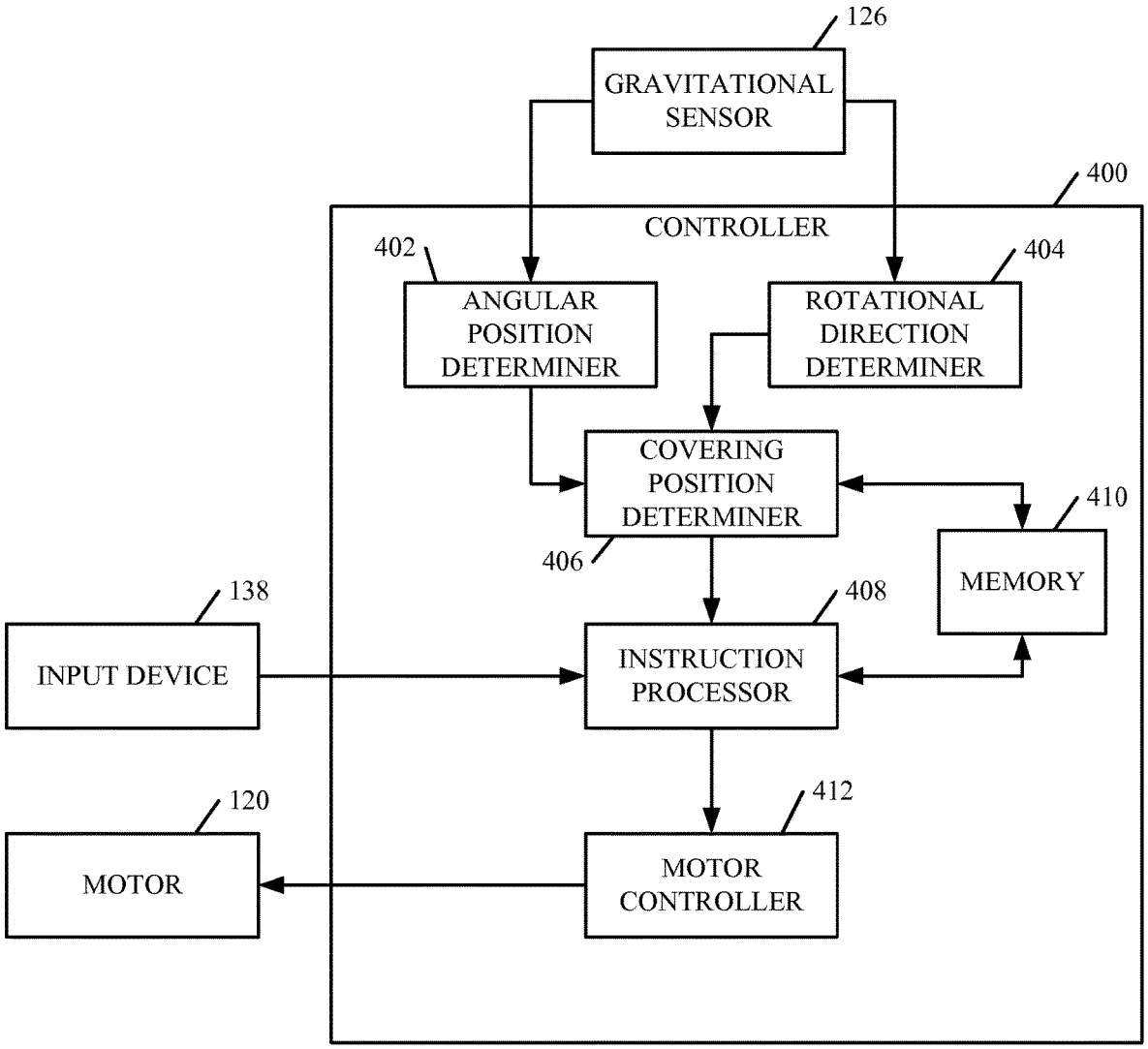
FIG. 4 is a block diagram representative of an example controller, which may control the example architectural opening covering assemblies of FIGS. 1-3.

FIG. 4 is a block diagram of an example controller 400 disclosed herein, which may implement the example controller 122 of FIGS. 1-2 and/or the example controller 308 of FIG. 3. Although the example controller 400 of FIG. 4 is described below in conjunction with the example architectural opening covering assembly 100 of FIGS. 1-2, the example controller 400 may be employed as the controller of other examples such as the controller 308 of the architectural opening covering assembly 300 of FIG. 3.

In the illustrated example, the controller 400 includes an angular position determiner 402, a rotational direction determiner 404, a covering position determiner 406, an instruction processor 408, a memory 410 and a motor controller 412. During operation of the controller 400, the gravitational sensor 126 generates tube position information (e.g., voltages corresponding to g-forces experienced along dual axes of the gravitational sensor 126). The tube position information is transmitted to the angular position determiner 402 and/or the rotational direction determiner 404 (e.g., via a wire). In the illustrated example, the angular position determiner 402 processes the tube position information and/or determines an angular position of the tube 104 (e.g., relative to a gravitational field vector of Earth) based on the tube position information.

The example rotational direction determiner 404 of FIG. 4 determines a direction of rotation of the tube 104 such as, for example, clockwise or counterclockwise based on the angular positions of the tube 104 and/or the tube position information. In the illustrated example, the rotational direction determiner 404 determines the direction of rotation based on how the first value and/or the second value outputted by the example gravitational sensor 126 changes as the tube 104 rotates. The example the rotational direction determiner 404 associates the direction of rotation of the tube 104 with raising or lowering the example covering 106. For example, during initial setup, after a disconnection of power, etc., the rotational direction determiner 404 associates the direction of rotation of the tube 104 with raising or lowering the example covering 106 based on a first voltage supplied to the motor 120 to rotate the tube 104 in a first direction and a second voltage supplied to the motor 120 to rotate the tube 104 in a second direction (e.g., if the first voltage is greater than the second voltage and, thus, a first load on the motor to rotate the tube 104 in the first direction is greater than a second load on the motor to rotate the tube 104 in the second direction, the first voltage is associated with raising the covering 106).

In some examples, the example instruction processor 408 may receive instructions via the input device 138 to raise or lower the covering 106. In some examples, in response to receiving the instructions, the instruction processor 408 determines a direction of rotation of the tube 104 to move the covering 106 to a commanded position and/or an amount of rotation of the tube 104 to move the covering 106 to the commanded position. In the illustrated example, the instruction processor 408 sends instructions to the motor controller 412 to operate the motor 120.

The example memory 410 of FIG. 4 organizes and/or stores information such as, for example, a position of the covering 106, a direction of rotation of the tube 104 to raise the covering 106, a direction of rotation of the tube 104 to lower the covering 106, one or more reference positions of the covering 106 (e.g., a fully unwound position, an upper limit position, a lower limit position, etc.), and/or any other information that may be utilized during the operation of the architectural opening covering assembly 100.

The example motor controller 412 sends signals to the motor 120 to cause the motor 120 to operate the covering 106 (e.g., lower the covering 106, raise the covering 106, and/or prevent (e.g., brake, stop, etc.) movement of the covering 106, etc.). The example motor controller 412 of FIG. 4 is responsive to instructions from the instruction processor 408. The motor controller 412 may include a motor control system, a speed controller (e.g., a pulse width modulation speed controller), a brake, or any other component for operating the motor 120. In some examples, the example motor controller 412 of FIG. 4 controls a supply of the voltage (e.g., corresponding to power) to the motor 120 to regulate the speed of the motor 120.

The example covering position determiner 406 of FIG. 4 determines a position of the covering 106 relative to a reference position such as, for example, a previously stored position, a fully unwound position, a lower limit position, an upper limit position and/or any other reference position. To determine the position of the covering 106, the example covering position determiner 406 determines an angular displacement (i.e., an amount of rotation) of the tube 104 from a given position such as, for example, a previously stored position and/or any other position, and the covering position determiner 406 increments a number of revolutions of the tube 104 from the reference position. The covering position determiner 406 may adjust a stored position of the covering 106. In some examples, the covering position determiner 406 determines the position of the covering 106 in units of degrees of tube rotation relative to the reference position (e.g., based on the angular position of the tube 104 determined via the angular position determiner 402 and the direction of rotation of the tube 104 determined via the rotational direction determiner 404) and/or any other unit of measurement.

While an example manner of implementing the controller 400 has been illustrated in FIG. 4, one or more of the elements, processes and/or devices illustrated in FIG. 4 may be combined, divided, re-arranged, omitted, eliminated and/or implemented in any other way. Further, the example gravitational sensor 126, angular position determiner 402, rotational direction determiner 404, covering position determiner 406, instruction processor 408, motor controller 412, input device 138, memory 410, and/or the example controller 400 of FIG. 4 may be implemented by hardware, software, firmware and/or any combination of hardware, software and/or firmware. Thus, for example, any of the example gravitational sensor 126, angular position determiner 402, rotational direction determiner 404, covering position determiner 406, instruction processor 408, motor controller 412, input device 138, memory 410, and/or the example controller 400 of FIG. 4 could be implemented by one or more circuit(s), programmable processor(s), application specific integrated circuit(s) (ASIC(s)), programmable logic device(s) (PLD(s)) and/or field programmable logic device(s) (FPLD(s)), etc. When any of the apparatus or system claims of this patent are read to cover a purely software and/or firmware implementation, at least one of the example gravitational sensor 126, angular position determiner 402, rotational direction determiner 404, covering position determiner 406, instruction processor 408, motor controller 412, input device 138, memory 410, and/or the example controller 400 of FIG. 4 are hereby expressly defined to include a tangible computer readable medium such as a memory, DVD, CD, Blu-ray, etc. storing the software and/or firmware. Further still, the example controller 400 of FIG. 4 may include one or more elements, processes and/or devices in addition to, or instead of, those illustrated in FIG. 4, and/or may include more than one of any or all of the illustrated elements, processes and devices.

Figure 5:
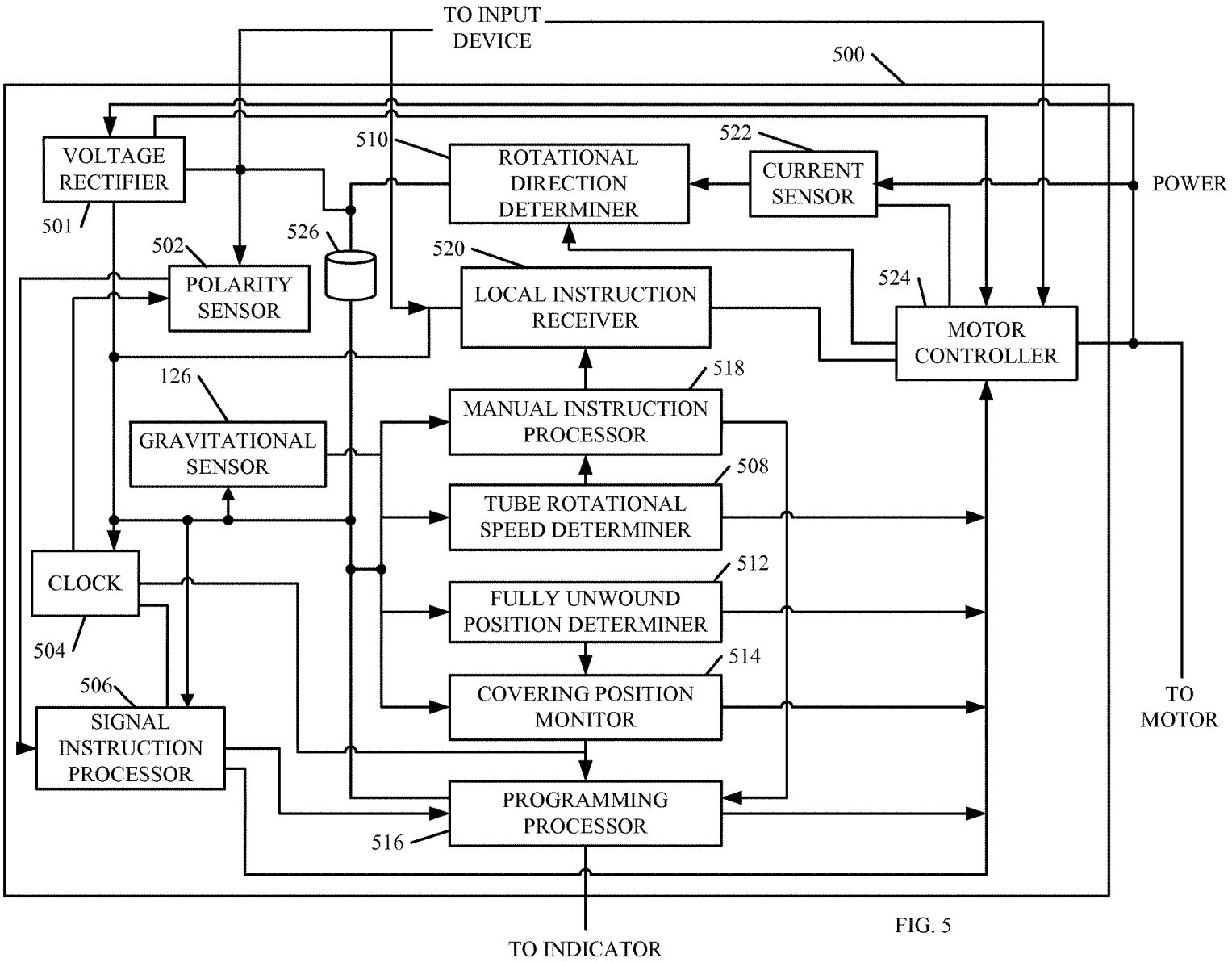
FIG. 5 is a block diagram representative of another example controller, which may control the example architectural opening covering assemblies of FIGS. 1-3.

FIG. 5 is a block diagram of another example controller 500 disclosed herein, which may be used to implement the example controller 100 of FIGS. 1-2 and/or the example controller 308 of FIG. 3. Thus, although the example controller 500 of FIG. 5 is described below in conjunction with the example architectural opening covering assembly 100 of FIGS. 1-2, the example controller 500 may be employed as the controller 308 of the architectural opening covering assembly 300 of FIG. 3 and/or as a controller from another type of covering assembly. Thus, the gravitational sensor 126 and/or any other components of the example controller 500 may be disposed inside a tube or outside the tube, etc., In the illustrated example, the controller 500 includes a voltage rectifier 501, a polarity sensor 502, a clock or timer 504, a signal instruction processor 506, the gravitational sensor 126, a tube rotational speed determiner 508, a rotational direction determiner 510, a fully unwound position determiner 512, a covering position monitor 514, a programming processor 516, a manual instruction processor 518, a local instruction receiver 520, a current sensor 522, a motor controller 524, and an information storage device or memory 526.

During operation, the example polarity sensor 502 determines a polarity (e.g., positive or negative) of a voltage source (e.g., a power supply) supplied to the controller 500. As described in further detail herein, the voltage source may be the input device 138 and/or may be provided via the input device 138. In some examples, the voltage source is conventional power supplied via a house wall and/or a building. In other examples, the voltage source is a battery. In the illustrated example, the input device 138 modulates (e.g., alternates) the polarity of the power supplied to the controller 500 to signal commands or instructions (e.g., lower the covering 106, raise the covering 106, move the covering 106 to position X, etc.) to the controller 500. The example polarity sensor 502 receives timing information from the clock 504 to determine the duration of modulations of the polarity of the voltage (e.g., to determine that the polarity was switched from negative to positive, and held positive for 0.75 seconds indicating that the covering 106 should be moved to 75% lowered). Thus, the illustrated example employs pulse width modulation to convey commands. The example polarity sensor 502 of the illustrated example provides polarity information to the rotational direction determiner 510, the memory 526, and the motor controller 524.

The voltage rectifier 501 of the illustrated example converts the signal transmitted by the input device 138 to a direct current signal of a predetermined polarity. This direct current signal is provided to any of the components of the controller 500 that are powered (e.g., the programming instruction processor 516, the memory 526, the motor controller 524, etc.). Accordingly, modulating the polarity of the power signal to provide instructions to the controller 500 will not interfere with the operation of components that utilize a direct current signal for operation. Although the illustrated example modulates the polarity of the power signal, some examples modulate the amplitude of the signal.

The example clock or timer 504 provides timing information using, for example, a real-time clock. The clock 504 may provide information based on the time of day and/or may provide a running timer not based on the time of day (e.g., for determining an amount of time that has elapsed in a given period). In some examples, the clock 504 is used to determine a time of day at which a manual input occurred. In other examples, the clock 504 is used to determine an amount of time elapsed without a manual input. In other examples, the clock 504 is used by the polarity sensor 502 to determine a duration of a modulation (e.g., polarity change).

The example signal instruction processor 506 determines which of a plurality of actions are instructed by the signal transmitted from the input device 138 to the example controller 500. For example, the signal instruction processor 506 may determine, via the polarity sensor 502, that a modulation of the input power (e.g., a signal having two polarity changes (e.g., positive to negative and back to positive) within one second) corresponds to a command to raise the example covering 106.

The example tube rotational speed determiner 508 determines a speed of rotation of the tube 104 using tube position information from the gravitational sensor 126. Information from the tube rotational speed determiner 508 facilitates a determination that a manual input is provided to the example architectural opening covering assembly 100. For example, when the motor 120 is operating and the tube 104 is moving faster or slower than the speed at which the motor 120 is driving the tube 104, the speed difference is assumed to be caused by a manual input (e.g., a user pulling on the covering 106).

The fully unwound position determiner 512 determines a position of the covering 106 where the covering 106 is fully unwound from the tube 104. In some examples, the fully unwound position determiner 512 determines the fully unwound position based on movement of the tube 104 as described in further detail below. Because the fully unwound position will not change for the covering 106 (e.g., unless the covering 106 is physically modified or an obstruction is present) the fully unwound position is a reference that can be used by the controller 500. In other words, once the fully unwound position is known, other positions of the covering 106 can be referenced to that fully unwound position (e.g., the number of rotations of the tube 104 from the fully unwound position to a desired position). If the current position of the covering 106 is later unavailable (e.g., after a power loss, after the architectural opening covering assembly 100 is removed and reinstalled, etc.), the controller 500 can move the covering 106 to a desired position by moving the covering 106 to the fully unwound position as determined by the fully unwound position determiner 512 and then rotating the tube 104 the known number of rotations to reach the desired position of the covering 106.

The example covering position monitor 514 of FIG. 5 determines positions of the covering 106 during operation via the example gravitational sensor 126. In some examples, the position of the covering 106 is determined based on a number of rotations of the tube 104 relative to the fully unwound position. In some examples, the position of the covering 106 is determined in units (e.g., fractions) of revolutions and/or degrees or rotation (e.g., relative to the fully unwound position).

The example rotational direction determiner 510 of FIG. 5 determines a direction of rotation of the tube 104 such as, for example, clockwise or counterclockwise via the gravitational sensor 126. In some examples, the rotational direction determiner 510 associates the direction of rotation of the tube 104 with raising or lowering the example covering 106. For example, during initial setup, after a disconnection of power, etc., the rotational direction determiner 510 may determine the direction of rotation of the tube 104 by operating the example motor 120 using the supplied voltage.

The example current sensor 522 of FIG. 5 determines an amperage of a current supplied to drive the example motor 120. During operation, a first amperage provided to drive the motor 120 to raise the covering 106 is greater than a second amperage provided to drive the motor 120 to lower the covering 106 or to enable the covering 106 to lower. Accordingly, the current sensed by the current sensor 522 is used by the rotational direction determiner 510 to determine the direction of rotation of the tube 104.

The example manual instruction processor 518 of FIG. 5 monitors the architectural opening covering assembly 100 for manual inputs such as, for example, rotation of the tube 104 caused by and/or affected by the covering 106 contacting an obstruction, the covering 106 being pulled, the input device providing a force to the tube, etc. The example manual instruction processor 518 determines that the manual input is being provided when rotation of the tube 104 is sensed by the gravitational sensor 126 while the motor 120 is not operated by the motor controller 524 and/or the speed of rotation of the tube 104 as sensed by the tube rotational speed determiner 508 is greater than or less than thresholds of rotational speed of the tube 104 expected via operation of the motor 120 by the motor controller 524. The manual instruction processor 518 of the illustrated example also determines if the manual input is a command (e.g., a command to stop or move the covering 106, or any other command). Detection of commands is described in further detail below.

In some examples, the example local instruction receiver 520 receives signals (e.g., a RF signal) from the input device 138. In some examples, the signals correspond to an action such as, for example, raising or lowering the covering 106. After receiving the signals from the input device 138, the example local instruction receiver 520 instructs the motor controller 524 to move the covering 106 based on the action corresponding to the signals.

The example programming processor 516 of FIG. 5 enters a programming mode in response to a command from the input device. The example programming processor 516 determines and records positions of the covering 106 such as, for example, a lower limit position, an upper limit position, and/or any other desired position entered by a user (e.g., via the input device). The programming processor 516 stores position information in the memory 526.

The example information storage device or memory 526 stores (a) rotational direction associations with polarity and operation of the motor 120, (b) commands or instructions and their associated signal patterns (e.g., polarity switches), (c) covering positions (e.g., current positions, preset positions, etc.), (d) amperages associated with operation of the motor 120, and/or (e) any other information.

The example motor controller 524 of FIG. 5 sends signals to the motor 120 to cause the motor 120 to operate the covering 106 (e.g., lower the covering 106, raise the covering 106, and/or prevent (e.g., brake, stop, etc.) movement of the covering 106, etc.). The example motor controller 524 of FIG. 5 is responsive to instructions from the signal instruction processor 506, the local instruction receiver 520, the fully unwound position determiner 512, and/or the programming processor 516. The motor controller 524 may include a motor control system, a speed controller (e.g., a pulse width modulation speed controller), a brake, or any other component for operating the motor 120. The example motor controller 524 of FIG. 5 controls the supply of the voltage (i.e., power) provided by the voltage rectifier 501 to the motor 120 to regulate the speed of the motor 120).

While an example manner of implementing the controller 500 has been illustrated in FIG. 5, one or more of the elements, processes and/or devices illustrated in FIG. 5 may be combined, divided, re-arranged, omitted, eliminated and/or implemented in any other way. Further, the example voltage rectifier 501, polarity sensor 502, clock or timer 504, signal instruction processor 506, gravitational sensor 126, tube rotational speed determiner 508, rotational direction determiner 510, fully unwound position determiner 512, covering position monitor 514, programming processor 516, manual instruction processor 518, local instruction receiver 520, current sensor 522, motor controller 524, information storage device or memory 526, and/or the example controller 500 of FIG. 5 may be implemented by hardware, software, firmware and/or any combination of hardware, software and/or firmware. Thus, for example, any of the example voltage rectifier 501, polarity sensor 502, clock or timer 504, signal instruction processor 506, gravitational sensor 126, tube rotational speed determiner 508, rotational direction determiner 510, fully unwound position determiner 512, covering position monitor 514, programming processor 516, manual instruction processor 518, local instruction receiver 520, current sensor 522, motor controller 524, information storage device or memory 526, and/or the example controller 500 could be implemented by one or more circuit(s), programmable processor(s), application specific integrated circuit(s) (ASIC(s)), programmable logic device(s) (PLD(s)) and/or field programmable logic device(s) (FPLD(s)), etc. When any of the apparatus or system claims of this patent are read to cover a purely software and/or firmware implementation, at least one of the example, the example voltage rectifier 501, polarity sensor 502, clock or timer 504, signal instruction processor 506, gravitational sensor 126, tube rotational speed determiner 508, rotational direction determiner 510, fully unwound position determiner 512, covering position monitor 514, programming processor 516, manual instruction processor 518, local instruction receiver 520, current sensor 522, motor controller 524, information storage device or memory 526, and/or the example controller 500 are hereby expressly defined to include a tangible computer readable medium such as a memory, DVD, CD, Blu-ray, etc. storing the software and/or firmware. Further still, the example controller 500 of FIG. 5 may include one or more elements, processes and/or devices in addition to, or instead of, those illustrated in FIG. 5, and/or may include more than one of any or all of the illustrated elements, processes and devices.

Flowcharts representative of example machine readable instructions that may be executed to implement the example controller 122 of FIG. 1, the example controller 308 of FIG. 3, example controller 400 of FIG. 4 and/or the example controller 500 of FIG. 5 are shown in FIGS. 6-13. In these examples, the machine readable instructions comprise a program for execution by a processor such as the processor 1412 shown in the example processor platform 1400 discussed below in connection with FIG. 14. The program may be embodied in software stored on a tangible computer readable medium such as a CD-ROM, a floppy disk, a hard drive, a digital versatile disk (DVD), a Blu-ray disk, or a memory associated with the processor 1412, but the entire program and/or parts thereof could alternatively be executed by a device other than the processor 1412 and/or embodied in firmware or dedicated hardware. Further, although the example program is described with reference to the flowcharts illustrated in FIGS. 6-13, many other methods of implementing the example controller 400 and/or the example controller 500 may alternatively be used. For example, the order of execution of the blocks may be changed, and/or some of the blocks described may be changed, eliminated, or combined.

As mentioned above, the example processes of FIGS. 6-13 may be implemented using coded instructions (e.g., computer readable instructions) stored on a tangible computer readable medium such as a hard disk drive, a flash memory, a read-only memory (ROM), a compact disk (CD), a digital versatile disk (DVD), a cache, a random-access memory (RAM) and/or any other storage media in which information is stored for any duration (e.g., for extended time periods, permanently, brief instances, for temporarily buffering, and/or for caching of the information). As used herein, the term tangible computer readable medium is expressly defined to include any type of computer readable storage device and/or storage disc and to exclude propagating signals and to exclude transmission media. Additionally or alternatively, the example processes of FIGS. 6-13 may be implemented using coded instructions (e.g., computer readable instructions) stored on a non-transitory computer readable medium such as a hard disk drive, a flash memory, a read-only memory, a compact disk, a digital versatile disk, a cache, a random-access memory and/or any other storage media in which information is stored for any duration (e.g., for extended time periods, permanently, brief instances, for temporarily buffering, and/or for caching of the information). As used herein, the term non-transitory computer readable medium is expressly defined to include any type of computer readable storage device and/or storage disc and to exclude propagating signals and to exclude transmission media.

Figure 6:
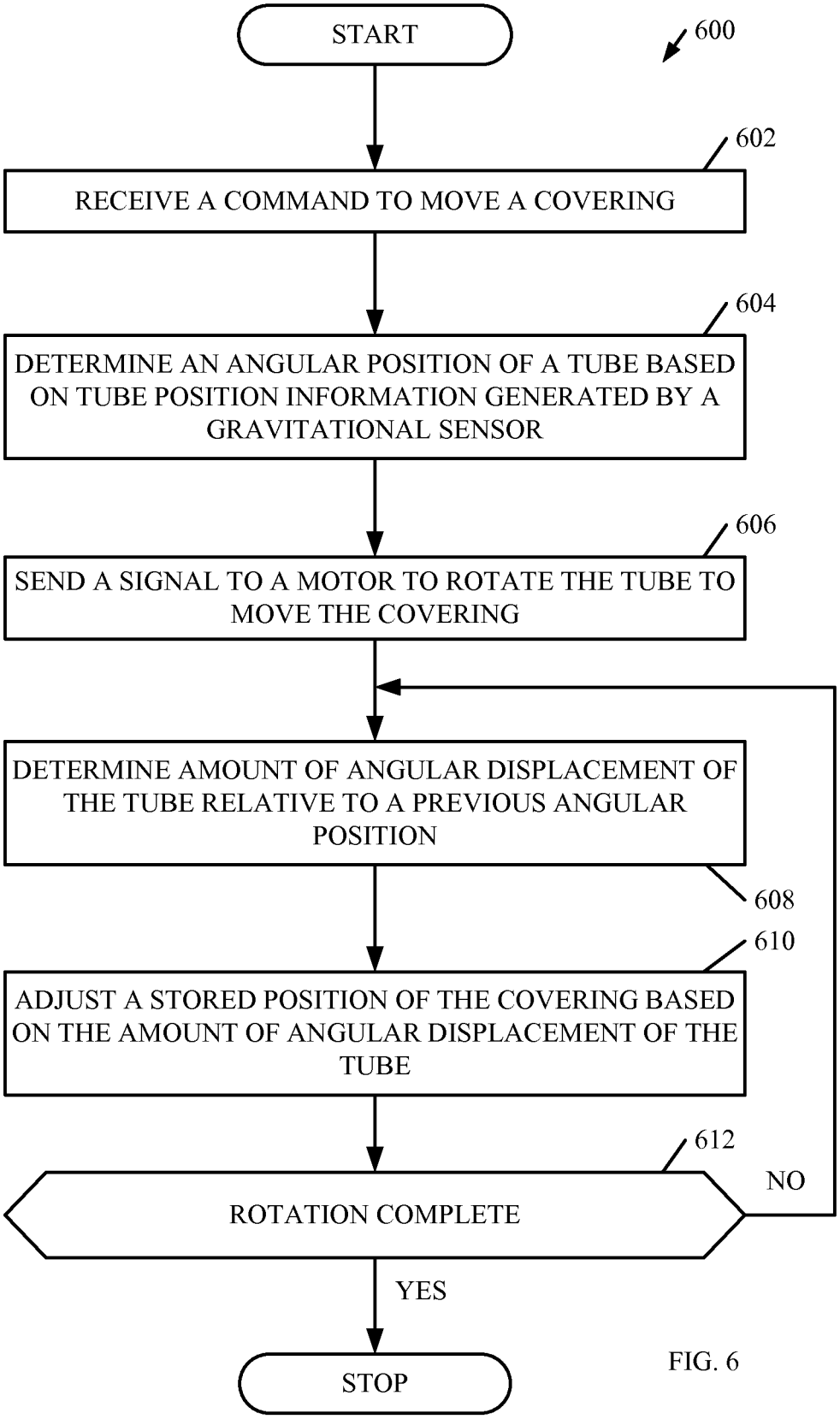
FIG. 6 is a flowchart representative of example machine readable instructions that may be executed to implement the example controller of FIG. 4.

FIG. 6 is a flow chart representative of example machine readable instructions that may be executed to implement the example controller 400 of FIG. 4. The example instructions 600 of FIG. 6 are executed to raise or lower the covering 106. In some examples, the instructions are initiated in response to a command from the input device 138 and/or the instruction processor 408.

The example instructions 600 of FIG. 6 begin by the instruction processor 408 receiving a command to move the covering 106 (block 602). For example, the instruction processor 408 may receive the command from the input device 138 to raise the covering 106; to lower the covering 106; to move the covering 106 to a lower limit position, an upper limit position, a preset position between the lower limit position and the upper limit position; etc. The angular position determiner 402 determines an angular position of the tube 104 based on tube position information generated by the gravitational sensor 126 (block 604). Based on the position of the covering 106 and the command, the instruction processor 408 instructs the motor controller 412 to send a signal to the motor 120 to rotate the tube 104 to move the covering 106. For example, if the covering 106 is at the lower limit position and the instruction received from the input device 138 is to move the covering 106 to the upper limit position, the instruction processor 408 provides instructions to the motor controller 412 to raise the covering 106. The example covering position determiner 406 may determine an amount of rotation of the tube 104 (e.g., 1.5 revolutions, etc.) to move the covering 106 to a commanded position.

The motor controller 412 sends a signal to the motor 120 to rotate the tube 104 to move the covering 106 (block 606). While the tube 104 is rotating, the covering position determiner 406 determines an amount of angular displacement of the tube 104 relative to a previous angular position (block 608). For example, the covering position determiner 406 may increment an amount of rotation of the tube 104 relative to the previous angular position and/or subtract the previous angular position from an angular position determined based on tube position information generated by the gravitational sensor 126. The covering position determiner 406 may also increment a number of revolutions rotated by the tube 104.

The covering position determiner 406 adjusts a stored position of the covering 106 based on the amount of angular displacement of the tube 104 (block 610). The example covering position determiner 406 determines the position of the covering 106 relative to a reference position such as, for example, the lower limit position, the fully unwound position, etc. The position of the covering 106 may be determined in units of degrees, revolutions, and/or any other unit of measurement relative to the reference position. In some examples, the covering position determiner 406 determines the position of the covering 106 based on tube position information generated by the gravitational sensor 126, the angular position information determined by the angular position determiner 402, the angular displacement of the tube 104, and/or previously stored position information.

The covering position determiner 406 determines if rotation of the tube 104 is complete. For example, the covering position determiner 406 may determine if the covering 106 is at the commanded position and/or if the tube 104 has rotated the amount of rotation determined by the covering position determiner 406 to move the covering 106 to the commanded position. If the rotation is not complete, the example instructions 600 return to block 608. If the rotation is complete (i.e., the covering 106 is at the commanded position or a limit position), the motor controller 412 sends a signal to the motor 120 to stop rotation of the tube 104 (block 612).

Figure 7:
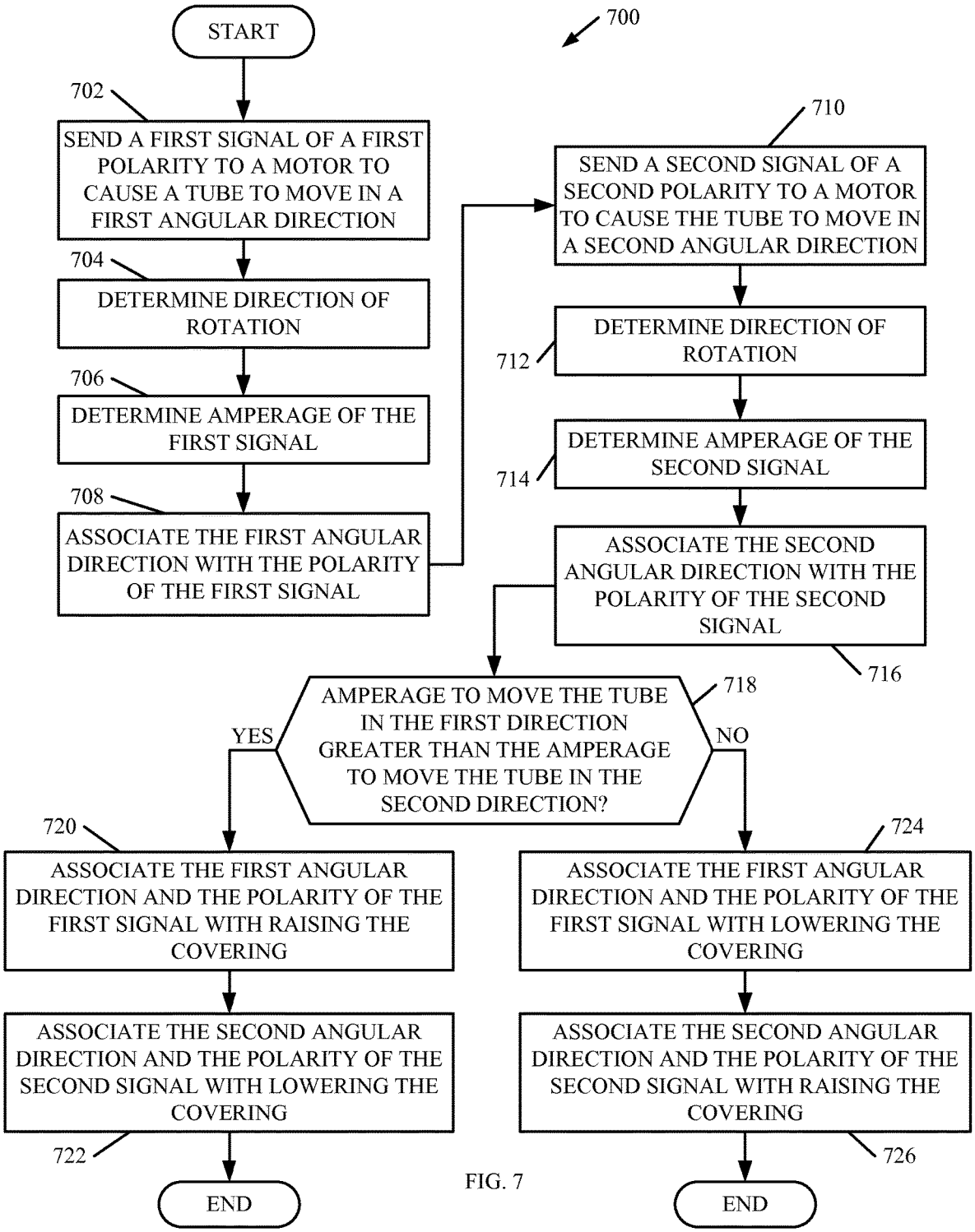
FIGS. 7-13 are flowcharts representative of example machine readable instructions that may be executed to implement the example controller of FIG. 5.

FIG. 7 is a flow chart representative of example machine readable instructions which may be executed to implement the example controller 500 of FIG. 5. The example instructions 700 of FIG. 7 are executed to determine the direction of rotation of the tube 104 that raises the covering 106 (i.e., winds the covering 106 around the tube 104) and, conversely, the direction of rotation of the tube 104 lowers the covering 106 (e.g., unwinds the covering 106 from the tube 104). In some examples, the instructions 700 are initiated in response to an initial supply of power to the controller 500, a manual input (e.g., a pull applied to the covering and rotating or rocking the tube), a command from the input device and/or the programming processor 516 (e.g., to enter a programming mode, etc.), a temporary loss of power to the controller 500, and/or other event or condition. In other examples, the instructions are executed continuously and/or whenever there is movement of the tube 104.

The example instructions 700 of FIG. 7 begins by the rotational direction determiner 510 responding to a command from the programming processor 516 by causing the motor controller 524 to send a first signal of a first polarity to the motor 120 to cause the tube 104 to move in a first angular direction (block 702). For example, the motor controller 524 of the controller 500 sends a signal (e.g., voltage and/or current) having a positive polarity to the motor 120 and, as a result, the motor 120 rotates the tube 104 in the first angular direction. The motor controller 524 receives a voltage from the voltage rectifier 501 that has a constant polarity and passes the voltage to the motor 120 directly or after modulating (e.g., switching) the polarity to a desired polarity.

The rotational direction determiner 510 determines the first angular direction (e.g., clockwise) based on movement of the tube 104 determined by the gravitational sensor 126 (e.g., an accelerometer) (block 704). The current sensor 522 determines an amperage of the first signal provided to the motor 120 (block 706). The rotational direction determiner 510 associates the first angular direction with the polarity of the first signal (block 708). For example, the rotational direction determiner 510 associates a positive polarity with a clockwise direction of rotation.

The motor controller 524 of the illustrated example sends a second signal of a second polarity to the motor 120 to cause the tube 104 to move in a second angular direction opposite the first angular direction (block 710). In some such examples, the motor 120 rotates the tube 104 or enables the tube 104 to rotate in the second angular direction (e.g., the motor 120 applies a torque less than a torque applied by the weight of the covering 106 to allow the weight of the covering 106 to rotate the tube 104 to unwind the covering 106). The rotational direction determiner 510 determines the second angular direction (e.g., counterclockwise) based on movement of the tube 104 determined by the gravitational sensor 126 (block 712). The current sensor 522 determines an amperage of the second signal (block 714). The rotational direction determiner 510 associates the second angular direction with the polarity of the second signal (block 716). In the illustrated example, the rotational direction determiner 510 associates the negative polarity with the counterclockwise direction.

The rotational direction determiner 510 determines whether the amperage provided to the motor 120 to move the tube 104 in the first direction is greater than the amperage provided to the motor 120 to move the tube 104 in the second direction (block 718). If the amperage provided to the motor 120 to move the tube 104 in the first direction is greater than the amperage provided to the motor 120 to move the tube 104 in the second direction, the rotational direction determiner 510 associates the first angular direction and the polarity of the first signal with raising the covering 106 (i.e., winding the covering 106 onto the tube 104) (block 720) and associates the second angular direction and the polarity of the second signal with lowering the covering 106 (i.e., unwinding the covering 106 from the tube 104) (block 722). If the amperage provided to the motor 120 to move the tube 104 in the first direction is less than the amperage provided to the motor 120 to move the tube 104 in the second direction, the rotational direction determiner 510 associates the first angular direction and the polarity of the first signal with lowering the covering 106 (block 724) and associates the second angular direction and the polarity of the second signal with raising the covering 106 (block 726). The associations may be stored in the memory 526 to be referenced by the controller 500 when receiving instructions to raise or lower the cover 102.

Figure 8:
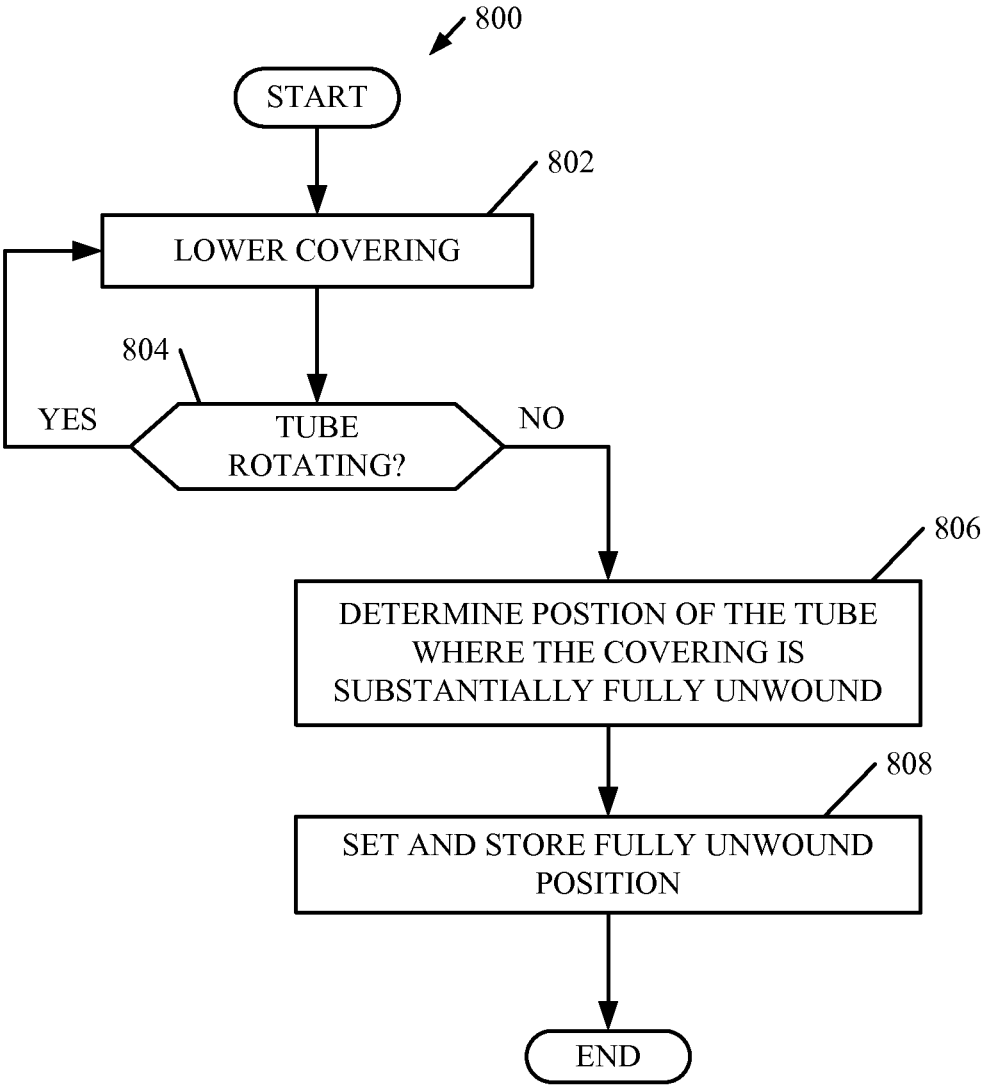

FIG. 8 is a flow chart of example machine readable instructions which may be executed to implement the example controller 500 of FIG. 5. The example instructions 800 of FIG. 8 are executed to determine and/or set a fully unwound position (e.g., where the covering 106 is fully unwound from the tube 104). The example instructions 800 may be initiated in response to an initial supply of power to the controller 500, a manual input, a command from the input device 138 and/or the programming processor 516, continuously whenever the tube 104 moves, and/or in response to any other event or condition.

In the example of FIG. 8, the instructions 800 begin when the fully unwound position determiner 512 responds to a command from the programming processor 516 to determine a fully unwound position by sending a signal to the motor controller 524 to lower the covering 106 (block 802). For example, the motor controller 524 responds to the signal from the fully unwound position determiner 512 by sending a signal to the motor 120 to cause the motor 120 to rotate in the unwinding direction. In some examples, a polarity of the signal is associated with the unwinding direction (e.g., by repeating the instructions of 700 of FIG. 7). In some examples, the motor 120 drives the tube 104 in the unwinding direction. In other examples, the motor 120 enables the weight of the covering 106 to cause the tube 104 to rotate in the unwinding direction and the motor 120 does not oppose the unwinding or opposes it with less force than the force applied by the weight of the covering 106.

The tube rotational speed determiner 508 of the illustrated example determines whether the tube 104 is rotating (block 804). For example, the gravitational sensor 126 (e.g., an accelerometer) detects movement of the tube 104, and the example rotational speed determiner 508 determines whether the position of the covering 106 is changing over a time imposed with reference to the example clock 504. In some examples, due to a provided dead band (i.e., a lost motion path) when the motor is operatively disengaged from the tube 104, a one-way gear that prevents the motor from driving the tube 104 in the unwinding direction, and/or any other component, the tube 104 stops rotating, at least temporarily, when the covering 106 reaches its lowermost position (e.g., the fully unwound position). If the rotational speed determiner 508 determines that the tube 104 is rotating, the example instructions 800 return to block 802 to continue waiting for the tube 104 to stop rotating, which indicates that the covering 106 has reached its lowermost position.

If the tube 104 is not rotating (block 804), the fully unwound position determiner 512 of the illustrated example determines the position of the tube 104 where the covering 106 is substantially fully unwound (i.e., the fully unwound position) (block 806). For example, when the motor 120 is provided with the signal to lower the covering 106 but the tube 104 is rotated to or past the fully unwound position, the motor 120 drives at least partially through the dead band. As a result, the tube 104 does not rotate for a time, and the lack of movement of the tube 104 is determined or sensed by the gravitational sensor 126 and the tube rotational speed determiner 508. Based on the signal sent to the motor 120 and the lack of movement of the tube 104 while the motor 120 drives through the dead band, the fully unwound position determiner 512 determines that the tube 104 is in the fully unwound position.

The programming processor 516 sets and stores the fully unwound position (block 808). In some examples, the fully unwound position is stored in the example information storage device 526 as a position of zero revolutions. In other examples, the fully unwound position is stored in the example information storage device 526 as a position relative to one or more frames of reference (e.g., a reference axis of the gravitational sensor 126, a previously determined fully unwound position, etc.). In some such examples, the fully unwound position is adjusted based on the one or more frames of reference.

In some examples, the covering position monitor 514 determines other position(s) of the tube 104 relative to the fully unwound position during operation of the example architectural opening covering assembly 100. For example, when the tube 104 is moved, the covering position monitor 514 determines a count of revolutions of the tube 104 in the winding direction away from the fully unwound position based on rotation information provided by the example gravitational sensor 126.

In some examples, after the fully unwound position is stored, the tube 104 is rotated one or more revolutions from the fully unwound position in the winding direction to reduce the strain of the covering 106 on the fixture that attaches the covering 106 to the tube 104. In such examples, the covering position monitor 514 determines or detects the amount of movement of the tube 104 in the winding direction based on the angular movement information provided by the gravitational sensor 126, and the motor controller 524 sends a signal to the motor 120 to drive the motor 120 in the winding direction.

Figure 9:
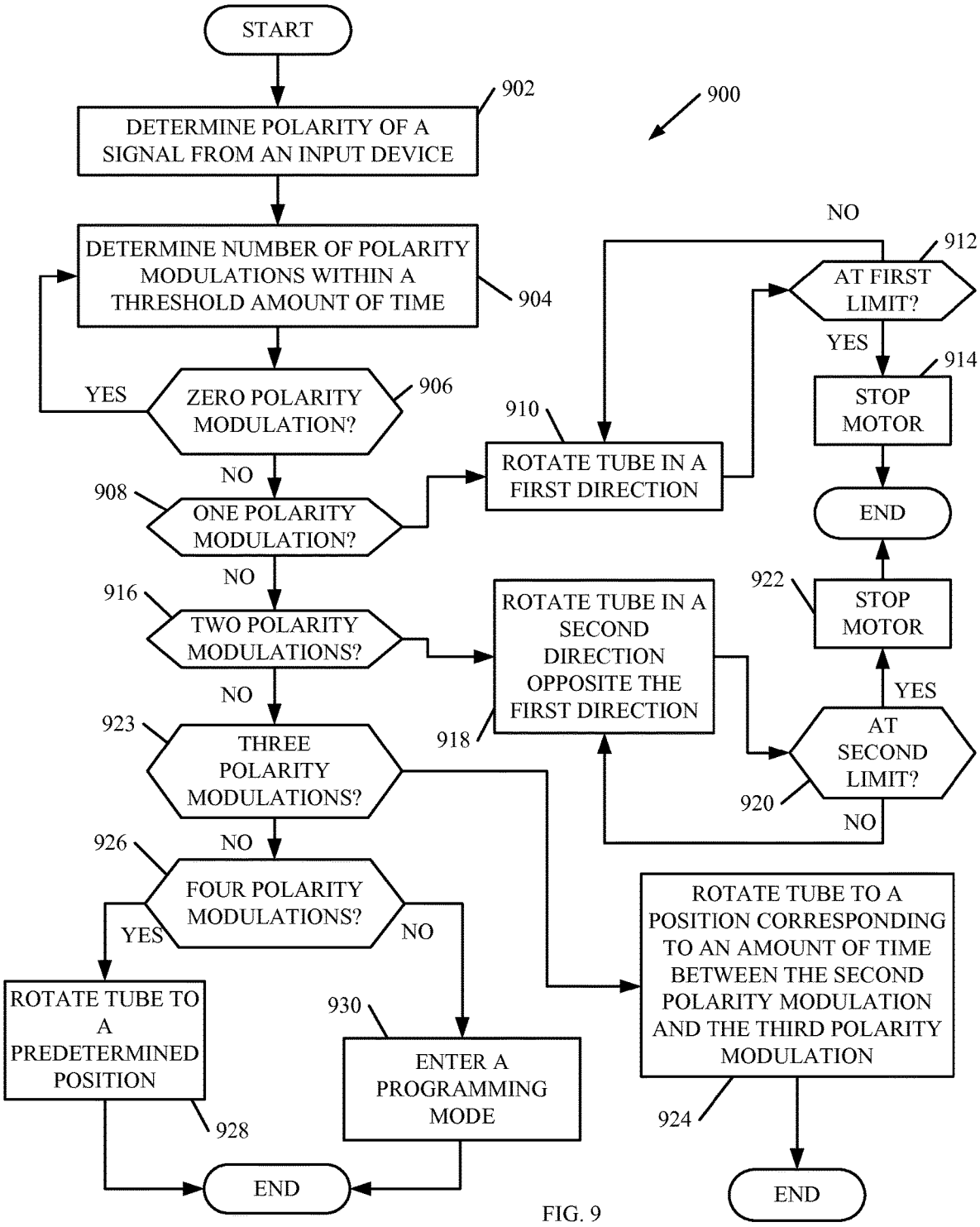

FIG. 9 is a flow chart of example machine readable instructions which may be executed to implement the controller 500 of FIG. 5. The example input device 138 transmits signals to the example controller 500 to provide instructions or commands to perform an action such as, for example, rotating the tube 104 via the motor 120, entering a programming mode, etc. In some examples, a polarity of the signal is modulated (e.g., alternated) by the input device 138 to define the instructions or commands. For example, particular polarity modulation patterns may be associated with particular instructions as described below. Other examples employ other communication techniques (e.g., data communication, packetized communication, other modulation techniques or algorithms, etc.).

The following commands and actions are merely examples, and other commands and/or actions may be used in other examples. The example instructions 900 of FIG. 9 begin when the polarity sensor 502 determines a polarity of a signal received from the input device 138 (block 902). In the illustrated example, the signal from the input device 138 has a positive polarity or a negative polarity, which can be modulated (e.g., alternated or reversed) by a polarity switch. The signal instruction processor 506 determines a number of polarity modulations within a corresponding amount of time (block 904). The amount of time is a time period that is sufficiently short to ensure that the entire command is recognized and that two commands or other fluctuations of the signal are not identified or misinterpreted as a first command. For example, if the polarity of the signal modulations from positive to negative to positive within the amount of time, the signal instruction processor 506 determines that two polarity modulations occurred within the measured amount of time. In some examples, the length of the time period is about one second. In some examples, the time period may be tracked by starting a timer when a first polarity modulation occurs and detecting polarity modulations that occur before the timer expires. Additionally or alternatively, a sliding window having a width equal to the time period may be used to analyze the signal and polarity modulations in the window may be detected. Any suitable method for determining polarity modulations may be used (e.g., a synch may be detected, a start signal and a stop signal may be detected, etc.).

If no (i.e., zero) polarity modulations occur in a given window (block 906), the example instructions 900 returns to block 904 to continue monitoring for polarity modulations. If one polarity modulation occurs (block 908), the motor controller 524 sends a signal to the motor 120 to rotate the tube 104 in a first direction (block 910). In some examples, if one polarity modulation occurs and the polarity of the signal modulated from positive to negative, the tube 104 rotates in a direction associated with the negative polarity. In some examples, the polarity of the signal is associated with the unwinding direction or the winding direction using the example instructions 700 of FIG. 7.

Then, the covering position monitor 514 determines if the covering 106 is at a first limit position (block 912). In some examples, the first limit position is a predetermined lower limit position such as, for example, a preset lower limit position, the fully unwound position, one revolution away from the fully unwound position in the winding direction, an upper limit position, or any other suitable position. The example covering position monitor 514 determines the position of the covering 106 based on the rotation of the tube 104 relative to the fully lowered position and/or the lower limit position. If the covering position monitor 514 determines that the covering 106 is not at the first limit position, the example instructions 900 return to block 910. If the covering position monitor 514 determines that the tube 104 is at the first limit position, the motor controller 524 causes the motor 120 to stop (block 914). The instructions of FIG. 9 may be terminated or may return to block 904.

Returning to the NO result of block 908, if two polarity modulations occur (block 916), the motor controller 524 sends a signal to the motor 120 to rotate the tube 104 in a second direction opposite the first direction (block 918). In some examples, if two polarity modulations occur and the polarity modulations from positive to negative to positive within the amount of time, the tube 104 is rotated in a direction associated with the positive polarity (e.g., the winding direction). At block 920, the covering position monitor 514 determines whether the covering 106 is at a second limit position. In some examples, the second limit is a predetermined upper limit position. If the covering 106 is not at the second limit position, the example instructions 900 returns to block 918 to wait for the tube 104 to reach the second limit position. If the covering 106 is at the second limit position, the motor controller 524 causes the motor 120 to stop (block 922). As described in greater detail below, the user may set the lower limit position and the upper limit position via a programming mode.

If three polarity modulations occur (block 923), the motor controller 524 sends a signal to the motor 120 to rotate the tube 104 to an intermediate position corresponding to an amount of time that passed between the second polarity modulation and the third polarity modulation (block 924). For example, the amount of opening may be indicated by an amount of time between 0 and 1 second. For example, if the amount of time between the second polarity modulation and the third polarity modulation is about 400 milliseconds, the motor controller 524 sends a signal to the motor 120 to rotate the tube 104 to a position corresponding to a position a distance of about 40 percent of a distance between the lower limit position and the upper limit position (i.e., the covering 106 is about 40 percent open). In some examples, amount of opening of the covering 106 that is desired and, thus, the amount of time in the command, corresponds to an amount of sunlight shining onto a side of a building in which the example architectural opening covering assembly 100 is disposed. For example, the input device 138 may include a light sensor to detect and measure light shining onto the side of the building, and the covering 106 will be opened further when there is less light and will be closed further when there is more light.

If four polarity modulations occur (block 926), the motor controller 524 sends a signal to the motor 120 to rotate the tube 104 to a predetermined position (block 928). In some examples, the predetermined position is an intermediate position between the lower limit and the upper limit. If the number of polarity modulations within the amount of time is greater than four, the example programming processor 516 causes the example controller 500 to enter a programming mode (block 930). As described in greater detail below, a user may set position limits using the input device 138 while the controller 500 is in the programming mode.

Figure 10:
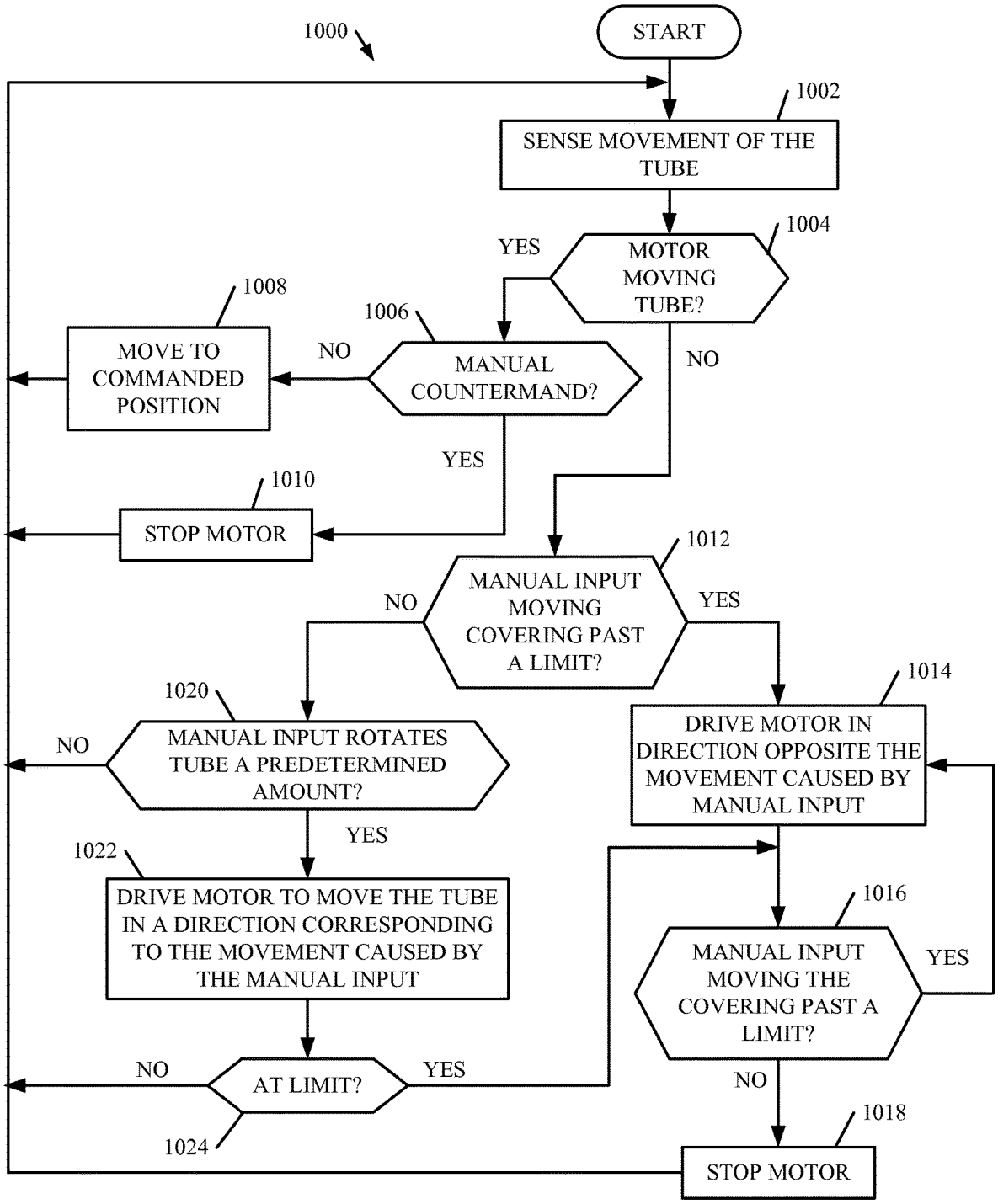

FIG. 10 is a flowchart representative of example machine readable instructions which may be executed to implement the example controller 500 of FIG. 5. In some examples, the controller 500, and the input device 138 cooperate to control the example architectural opening covering assembly 100 disclosed herein. In some examples, the tube rotational speed determiner 508 may detect a manual input and, based on the manual input, the motor controller 524 causes the motor 120 to facilitate or assist movement of the tube 104, prevent movement of the tube 104 (e.g., to prevent the manual input from moving the covering 106 past an upper or lower limit), or terminate operation of the motor 120. In some examples, the manual input may override operation of the motor 120 by the motor controller 524.

Because the gravitational sensor 126 determines tube position information and/or angular positions of the tube 104, the gravitational sensor 126 may be used to sense any manual input that causes the tube 104 to rotate and/or affects rotation of the tube 104 (e.g., speed of the rotation, direction of the rotation). In some examples, if the covering 106 is lifted, pulled, or contacts an obstruction (e.g., a hand of a user, a sill of an architectural opening, etc.), the tube 104 rotates, the tube 104 rotates at a speed different than the speed at which the motor 120 is to drive the tube 104, and/or the tube 104 rotates in a direction different than the direction in which the motor 120 is to rotate the tube 104. In some examples, operation of the input device 138 (e.g., a cord drivable actuator) rotates and/or affects rotation of the tube 104. Thus, based on the angular positions of the tube 104 determined via the gravitational sensor 126, the direction of rotation of the tube 104 determine by the tube directional determiner 510, and/or the speed of rotation of the tube 104 determined by the tube rotational speed determiner 508, the manual instruction processor 518 may determine that a manual input is occurring.

The example instructions 1000 of FIG. 10 begin with the covering position monitor 514 sensing movement of the tube 104 (block 1002). In some examples, the covering position monitor 514 continuously senses the position of the covering 106. For example, the gravitational sensor 126 and/or the covering position monitor 514 determines angular positions of rotation of the tube 104, which the covering position monitor 514 uses to determine positions of the covering 106 relative to the fully unwound position or the lower limit position. The tube rotational speed determiner 508 determines whether the motor 120 is moving the tube 104 (block 1004). For example, the tube rotational speed determiner 508 determines whether a manual input is moving the tube 104 or the motor 120 is moving the tube 104 in response to a command from the motor controller 524. If the motor 120 is moving the tube 104, the manual instruction processor 518 determines whether a manual countermand is being provided (block 1006). For example, if only the motor 120 is rotating the tube 104, the speed at which the tube 104 rotates is based on the speed of the motor 120. If the manual instruction processor 518 determines that the tube 104 is rotating at an unexpected speed or in an unexpected direction (e.g., rotating faster or slower than the speed at which only the motor 120 rotates the tube 104, not rotating, rotating in a direction opposite a direction commanded by the motor controller 524, etc.), then the manual instruction processor 518 determines that the manual input is being provided (e.g., via the input device 138, via a pull on the covering 106, via an obstruction contacting the covering 106, etc.). In some examples, if the manual input causes the tube 104 to rotate slower than the speed at which the motor 120 rotates the tube 104, stop rotating, and/or rotate in a direction opposite a direction commanded by the motor controller 524, the manual input is a manual countermand. In some examples, the manual countermand is a manual input in either a direction of the rotation of the motor 120 or the direction opposite the rotation of the motor 120.

If no manual countermand is provided (block 1006), the motor controller 524 sends a signal to the motor 120 to cause the tube 104 to move to a commanded position (block 1008). In some examples, the commanded position is the lower limit position, the upper limit position, or any other set position such as, for example, an intermediate position between the upper limit position and the lower limit position. The example instructions then returns to block 1202.

If a manual countermand is being provided (block 1006), the motor controller 524 sends a signal to stop the motor 120 (block 1010). Thus, the manual input may countermand or cancel the command from the motor controller 524. The example instructions then returns to block 1002.

Returning to block 1004, if the motor 120 is not moving the tube 104 (i.e., a manual input is moving the tube 104), the covering position monitor 514 determines whether the manual input is moving the covering 106 past a limit (block 1012). For example, a user may provide a manual input to rotate the tube 104 to move the covering 106 past the lower limit position or the upper limit position. In such examples, the covering position monitor 514 determines the position of the covering 106 relative to the lower limit position and/or the fully unwound position. In some examples, the current sensor 522 determines an amperage of the current supplied to the motor 120 to determine whether the tube 104 is rotating to move the covering 106 past the upper limit position. For example, if the covering 106 fully winds around the tube 104, an end of the covering 106 may engage a portion of the example architectural opening covering assembly 100, which causes the amperage supplied to the motor 120 to increase. In such examples, if the motor controller 524 determines that the increase in the amperage has occurred, the motor controller 524 determines that the tube 104 is rotating to move the covering 106 past the upper limit position. In other examples, if the manual input moves the covering 106 past the upper limit by a predetermined amount (e.g., one half of a rotation or more), the example controller 500 again determines the fully unwound position using, for example, the example instructions 800 of FIG. 8. For example, the fully unwound position may be determined again because it is assumed that the calibration of the tube rotation may have been lost because the covering 106 moved past an upper limit of the architectural opening covering assembly 100.

If the manual input is moving the covering 106 past the limit (block 1012), the motor controller 524 sends a signal to the motor 120 to drive the motor 120 in a direction opposite of the movement of the tube 104 caused by the manual input (block 1014). For example, if the manual input is moving the covering 106 past the lower limit position, the motor controller 524 sends a signal to the motor 120 to drive the tube 104 in the winding direction. The manual instruction processor 518 again determines whether the user is providing a manual input causing the covering 106 to move past the limit (block 1016). If the user is not providing a manual input causing the covering 106 to move past the limit, the motor controller 524 sends a signal to the motor 120 to stop (block 1018), and the example instructions returns to block 1002. Accordingly, the tube 104 is prevented from rotating to move the covering 106 past the limit.

Returning to block 1012, if the manual input is not moving the covering 106 past the limit, the manual instruction processor 518 determines whether the manual input has rotated the tube 104 a threshold amount (block 1020). In some examples, the threshold amount corresponds to at least a number of tube rotations. In some such examples, the threshold amount is at least a quarter of one revolution. In some examples, the manual instruction processor 518 determines whether the manual input is provided for a continuous amount of time (e.g., at least two seconds). In other examples, the manual instruction processor 518 determines whether the manual input is provided for a total amount of time such as, for example, two seconds within a threshold period amount of time such as, for example, 3 seconds. In some examples, the manual instruction processor 518 determines the amount of time the manual input is provided in only a first direction or a second direction. In some examples, the manual instruction processor 518 determines whether the manual input is equal to or greater than a threshold distance in the first direction or the second direction within the threshold amount of time.

If the manual instruction processor 518 determines that the manual input is not provided for a threshold amount of time or distance, the example instructions returns to block 1002. If the manual input is provided for the threshold amount of time or distance, the motor controller 524 sends a signal to the motor 120 to move the tube 104 in a direction corresponding to the movement of the tube 104 caused by the manual input (block 1022). For example, if the manual input causes the covering 106 to rise, the motor controller 524 sends a signal to the motor 120 to cause the motor 120 to drive the tube 104 in the winding direction. The covering position monitor 514 determines whether the covering 106 is at the limit (block 1024). If the covering 106 is not at the limit, the example instructions return to block 1002. If the covering 106 is at the limit, the manual instruction processor 518 determines whether the manual input is causing the covering 106 to move past the limit (block 1016). If the manual input is causing the covering 106 to move past the limit, the motor controller 524 sends a signal to the motor 120 to drive the tube 104 in the direction opposite of the movement caused by the manual input (block 1014). If the manual input is not causing the covering 106 to move past the limit, the motor controller 524 causes the motor 120 to stop (block 1018), and the example instructions returns to block 1002.

Figure 11:
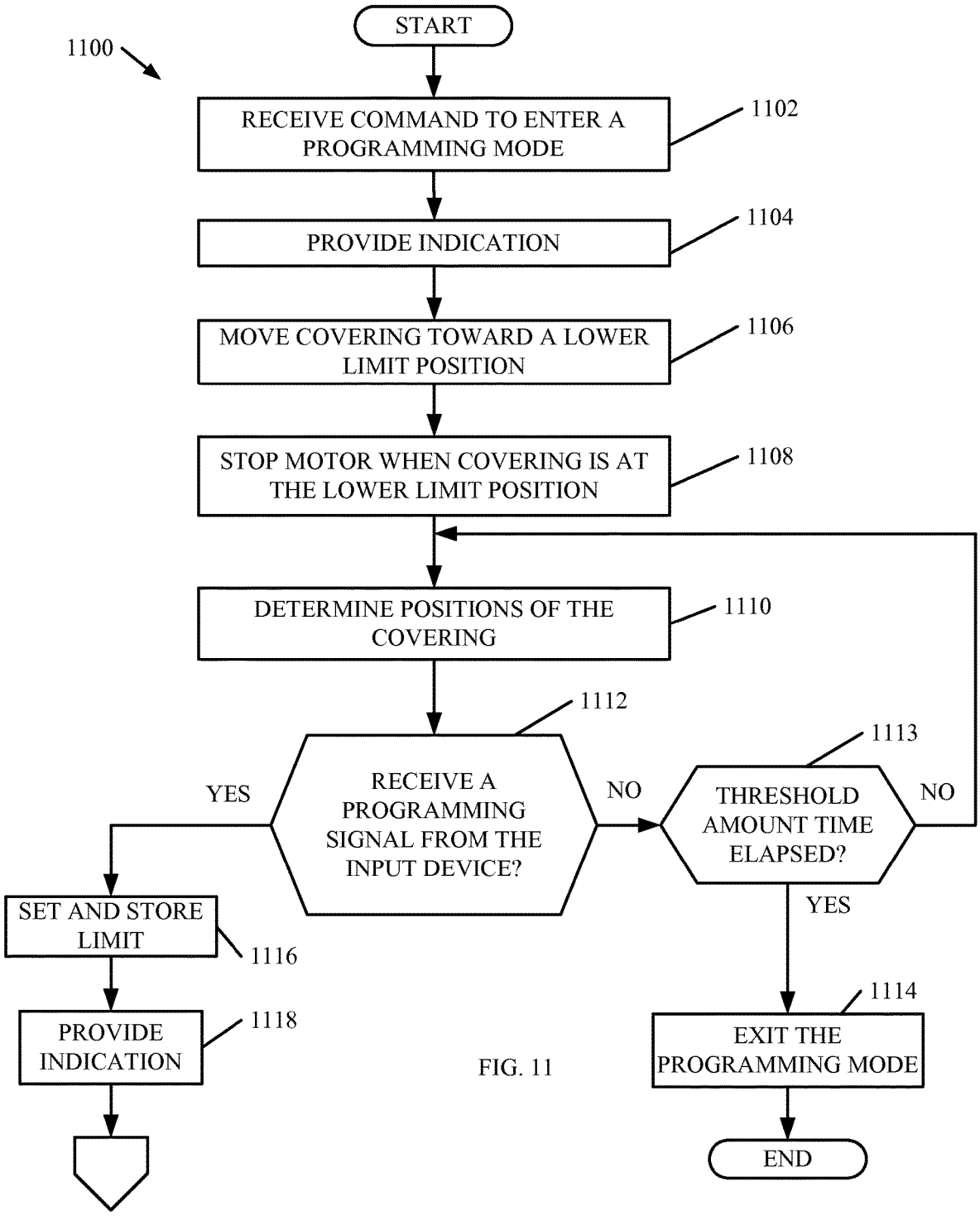
Figure 12:
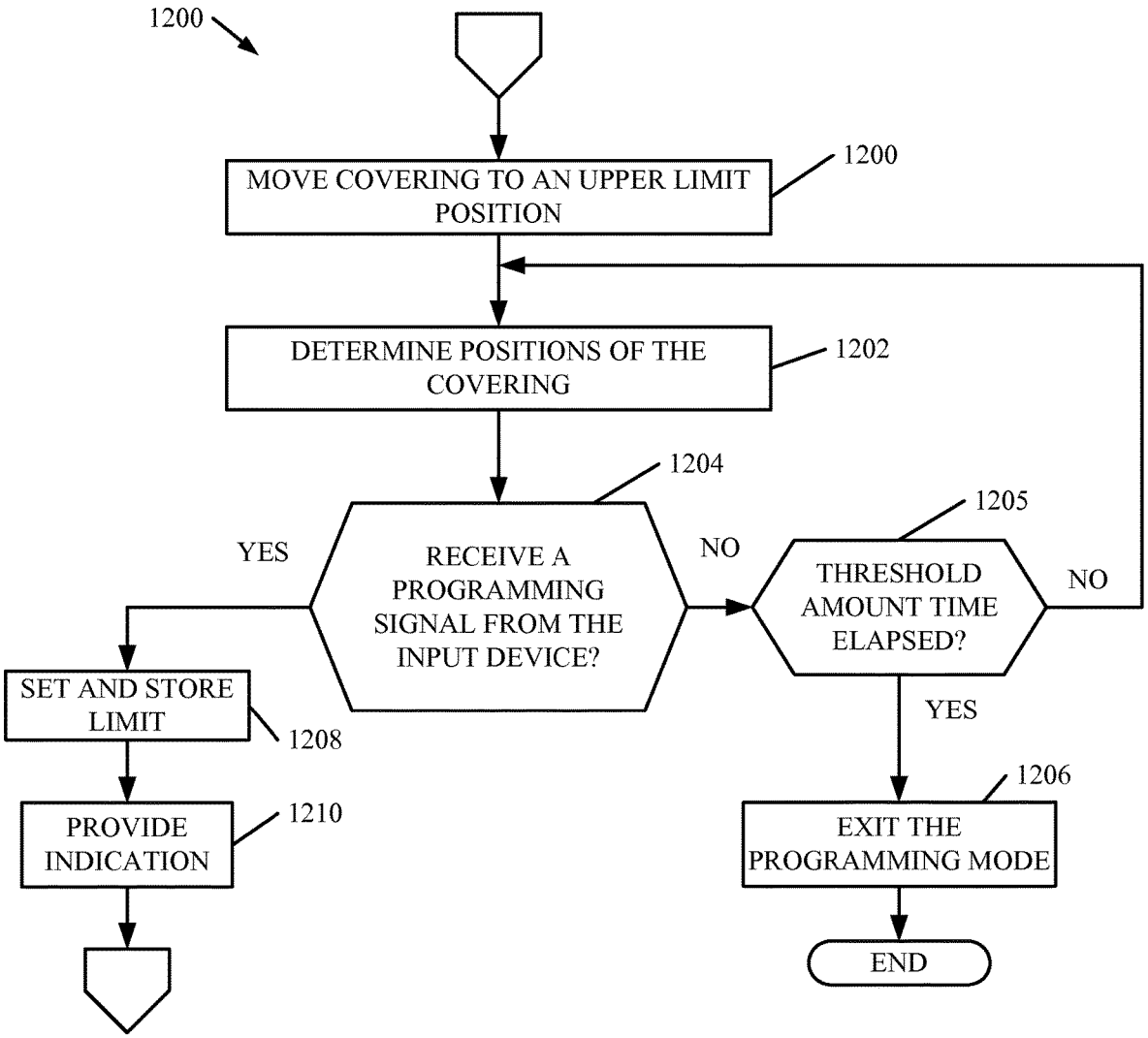
Figure 13:
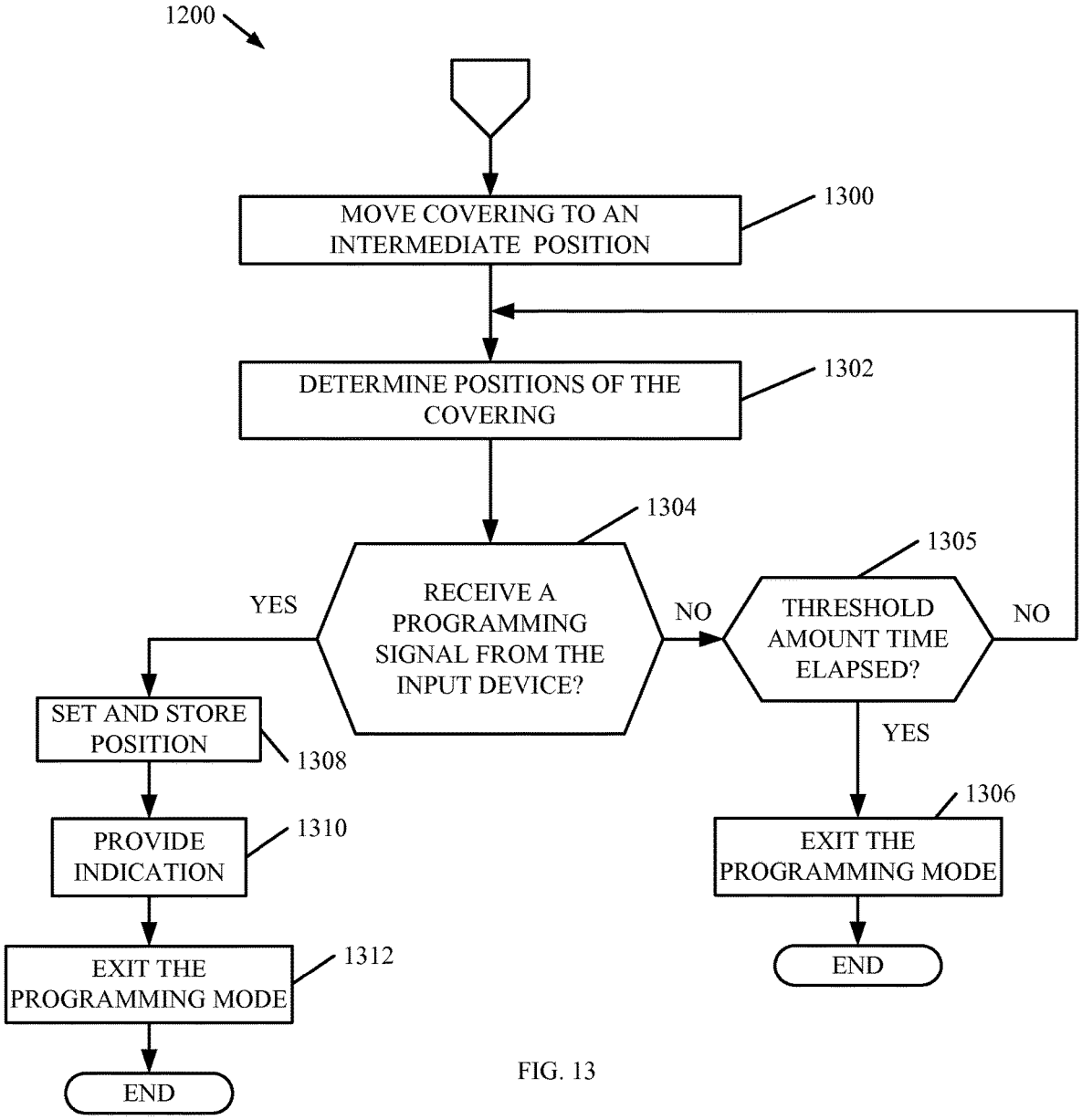

FIGS. 11-13 is a flow chart of example machine readable instructions 1100 which may be used to implement the example controller 500 of FIG. 5. In some examples, the input device 138 causes the example controller 500 to enter a programming mode in which the input device 138 is used to set one or more positions (e.g., lower limit position, an upper limit position, and/or other positions) of the covering 106. During normal operation or operative mode, when the input device 138 sends a signal to the controller 500 to move to the one of the positions, of the controller 500 causes the motor 120 to move the covering 106 to the position.

The example instructions 1100 of FIG. 11 begin with the controller 500 receiving a command from the input device 138 to enter a programming mode (block 1102). In some examples, the signal instruction processor 506 of the controller 500 determines that the signal from the input device 138 corresponds to a command to enter the programming mode using the example instructions 900 of FIG. 9. In some examples, in response to the command to enter the programming mode, the rotational direction determiner 510 determines the winding direction and the unwinding direction using the example instructions 700 of FIG. 7. In some examples, in response to receiving the command to enter the programming mode, the fully unwound position determiner 512 determines the fully unwound position of the covering 106 using the example instructions 800 of FIG. 8. After the input device 138 sends the command to the controller 500 to enter the programming mode, the input device 138 causes an indication to be provided (block 1104). For example, the input device 138 causes a sound to be provided, a light to blink, and/or any other suitable indication.

In response to the command from the input device 138, the motor controller 524 sends a signal to the motor 120 to move the covering 106 toward a lower limit position (e.g., a previously set lower limit position, the fully unwound position, one revolution of the tube 104 from the fully unwound position in the winding direction, etc.) (block 1106). In some examples, the manual instruction processor 518 continuously determines whether a manual countermand has occurred while the covering 106 is moving. For example, a manual countermand may be provided via a user. If the manual instruction processor 518 determines that a manual countermand occurred, the motor 120 is stopped. If the manual instruction processor 518 determines that no manual countermand occurred, the motor 120 is stopped when the covering 106 is at the lower limit position (block 1108). In other examples, the manual instruction processor 518 does not continuously determine whether a manual countermand occurs while the covering 106 is moving, and the motor 120 is stopped when the covering 106 is at the lower limit position.

The covering position monitor 514 determines positions of the covering 106 (block 1110). For example, after the covering 106 is stopped at the lower limit position, the user may rotate the tube 104 via the input device 138 (e.g., to a desired position), and the covering position monitor 514 determines positions of the covering 106 relative to the fully unwound position and/or the lower limit position based on the angular positions of the tube 104 detected by the gravitational sensor 126. The programming processor 516 determines whether a programming signal is received from the input device 138 (block 1112). In some examples, the programming processor 516 determines whether a signal sent from the input device 138 is a programming signal using the example instructions 900 of FIG. 9. In some such examples, the programming signal is a signal having six polarity modulations within a period of time (e.g., one second). If the programming processor 516 determines that the programming signal is not received, the programming processor 516 determines whether a threshold amount of time has elapsed (e.g., since the motor 120 was stopped at the lower limit position) (block 1113). If the threshold amount of time has elapsed, the programming processor 516 causes the controller 500 to exit the programming mode (block 1114). In some examples, the threshold amount of time is thirty minutes. If the threshold amount of time has not elapsed, the example instructions return to block 1110.

If the programming signal is received from the input device 138, the programming processor 516 sets a lower limit position (block 1116). In such examples, the lower limit position is a position of the covering 106 when the programming signal was received at block 1112. The input device causes an indication to be provided (block 1318).

Continuing to FIG. 12, after block 1118, the motor controller 524 sends a signal to the motor 120 to move the covering 106 to an upper limit position (block 1200). For example, if a previously set upper limit position exists, the motor controller 524 causes the motor 120 to rotate the tube 104 to move the covering 106 toward the previously set upper limit position. In some examples, no previously set upper limit position exists (e.g., after power is initially supplied to the example controller 500). If no previously set upper limit position exists, the motor controller 524 causes the motor 120 to rotate the tube 104 in the winding direction toward a position corresponding to a number of revolutions (e.g., one, two, one and one half, etc.) of the tube 104 in the winding direction from the lower limit position.

After the covering 106 moves to the upper limit position, the covering position monitor 514 determines positions of the covering 106 (block 1202). For example, after the covering 106 is stopped at the upper limit position, the user may move the covering 106 via the input device 138 (e.g., to a desired position), and the covering position monitor 514 determines positions of the covering 106 relative to the fully unwound position, the lower limit position, the upper limit position, etc.

The programming processor 516 determines whether a programming signal is received from the input device 138 (block 1204). If the programming processor 516 determines that the programming signal is not received, the programming processor 516 determines whether a threshold amount of time has elapsed (e.g., since the covering 106 moved to the upper limit position) (block 1205). If the threshold amount of time has not elapsed, the example instructions return to block 1202. If the threshold amount of time has elapsed, the programming processor 516 causes the controller 500 to exit the programming mode (block 1206). In some examples, the threshold amount of time is thirty minutes.

If the programming signal is received from the input device 138, the programming processor 516 sets an upper limit position (block 1208). The input device 138 causes an indication to be provided (block 1210).

Continuing to FIG. 13, after block 1210, the motor controller 524 sends a signal to the motor 120 to move the covering 106 to an intermediate position (i.e., a position between the lower limit position and the upper limit position) (block 1300). For example, if a previously set intermediate position exists, the motor controller 524 causes the motor 120 to rotate the tube 104 to move the covering 106 toward the previously set intermediate position. In some examples, no previously set intermediate position exists (e.g., after power is initially supplied to the example controller 500). If no previously set intermediate position exists, the motor controller 524 causes the motor 120 to rotate the tube 104 in the unwinding direction toward a position corresponding to a number of revolutions (e.g., one, two, one and one half, etc.) of the tube 104 in the unwinding direction from the upper limit position or toward any other suitable position (e.g., half way between the upper limit position and the lower limit position).

After the covering 106 moves to the intermediate position, the covering position monitor 514 determines positions of the covering 106 (block 1302). For example, after the covering 106 is stopped at the intermediate position, the user may move the covering 106 via the input device 138 (e.g., to a desired position), and the covering position monitor 514 determines positions of the covering 106 relative to the fully unwound position, the lower limit position, the upper limit position, etc.

The programming processor 516 determines whether a programming signal is received from the input device 138 (block 1304). If the programming processor 516 determines that the programming signal is not received, the programming processor 516 determines whether a threshold amount of time has elapsed (e.g., since the covering 106 was moved to the intermediate position) (block 1305). If the threshold amount of time has elapsed, the programming processor 516 causes the controller 500 to exit the programming mode (block 1306). If the programming processor 516 determines that the threshold amount of time has not elapsed, the example instructions return to block 1302. In some examples, the threshold amount of time is thirty minutes.

If the programming signal is received from the input device 138, the programming processor 516 sets and stores an intermediate position (block 1308). The input device 138 causes an indication to be provided (block 1310), and the programming processor 516 causes the controller 500 to exit the programming mode (block 1312). In some examples, the programming mode is used to set one or more other positions.

Figure 14:
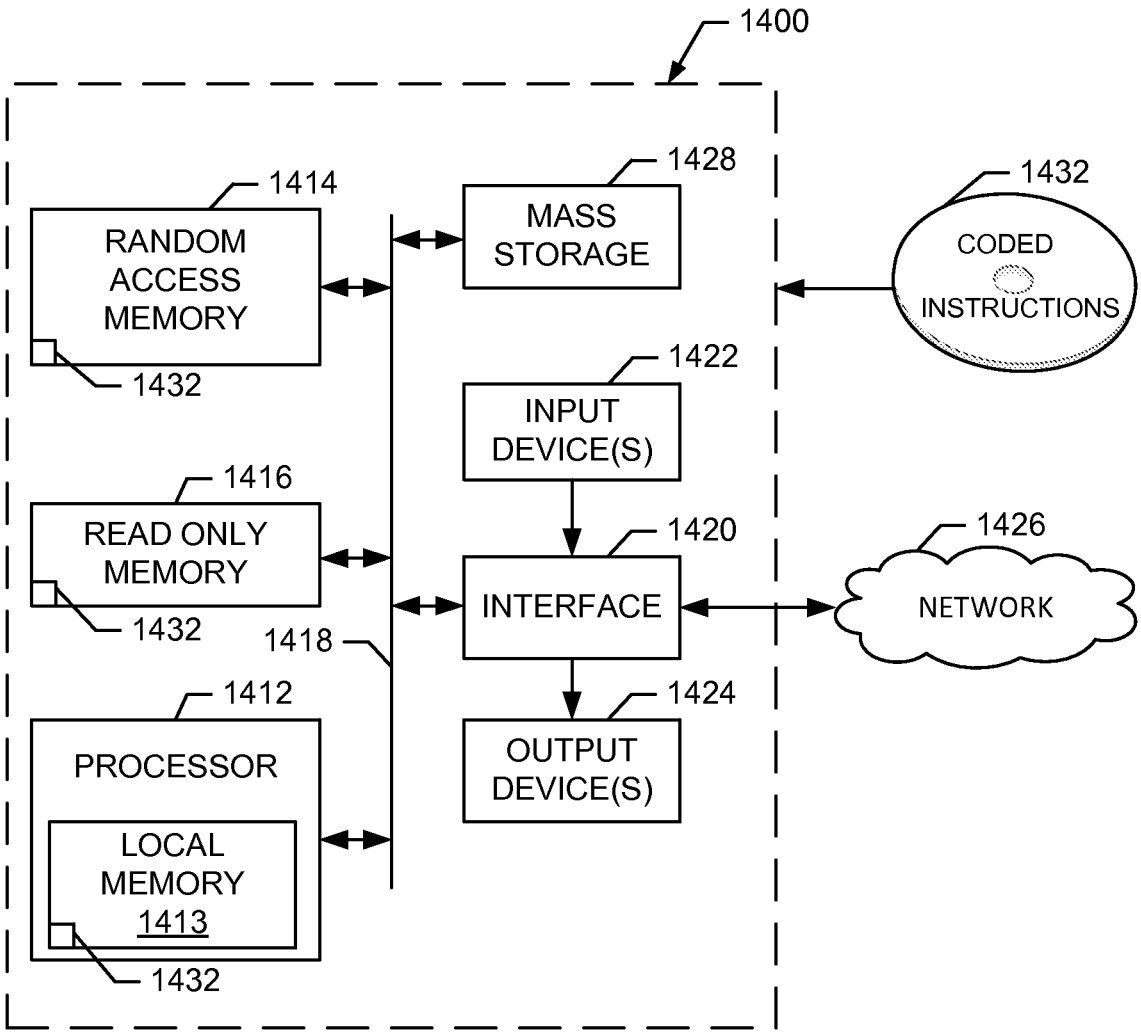
FIG. 14 is a block diagram of an example processing system that may execute the example machine readable instructions of FIGS. 6-13 to implement the controller of FIG. 4 and the controller of FIG. 5.

FIG. 14 is a block diagram of an example processor platform 1400 capable of executing the instructions of FIGS. 6-13 to implement the input device 138, the example first input device 310, the example second input device 312, the example controller 400 and/or the example controller 500. The processor platform 1400 can be, for example, a server, a personal computer, or any other suitable type of computing device.

The processor platform 1400 of the instant example includes a processor 1412. For example, the processor 1412 can be implemented by one or more microprocessors or controllers from any desired family or manufacturer.

The processor 1412 includes a local memory 1413 (e.g., a cache) and is in communication with a main memory including a volatile memory 1414 and a non-volatile memory 1416 via a bus 1418. The volatile memory 1414 may be implemented by Synchronous Dynamic Random Access Memory (SDRAM), Dynamic Random Access Memory (DRAM), RAMBUS Dynamic Random Access Memory (RDRAM) and/or any other type of random access memory device. The non-volatile memory 1416 may be implemented by flash memory and/or any other desired type of memory device. Access to the main memory 1414, 1416 is controlled by a memory controller.

The processor platform 1400 also includes an interface circuit 1420. The interface circuit 1420 may be implemented by any type of interface standard, such as an Ethernet interface, a universal serial bus (USB), and/or a PCI express interface.

One or more input devices 1422 are connected to the interface circuit 1420. The input device(s) 1422 permit a user to enter data and commands into the processor 1412. The input device(s) can be implemented by, for example, a keyboard, a mouse, a touchscreen, a track-pad, a trackball, isopoint, a button, a switch, and/or a voice recognition system.

One or more output devices 1424 are also connected to the interface circuit 1420. The output devices 1424 can be implemented, for example, by display devices (e.g., a liquid crystal display, speakers, etc.).

The processor platform 1400 also includes one or more mass storage devices 1428 (e.g., flash memory drive) for storing software and data. The mass storage device 1428 may implement the local storage device 1413.

The coded instructions 1432 of FIGS. 6-13 may be stored in the mass storage device 1428, in the volatile memory 1414, in the non-volatile memory 1416, and/or on a removable storage medium such as a flash memory drive.

From the foregoing, it will appreciate that the above disclosed instructions, methods, apparatus and articles of manufacture enable one or more architectural opening covering assemblies to be controlled by simply pulling on or otherwise applying force to the covering. The example architectural opening covering assemblies disclosed herein include a gravitational sensor to determine a position of an architectural opening covering, detect an input applied to the covering (e.g., by moving the covering by hand) and/or monitor movement of the covering based on gravity and/or movement relative to a gravity reference. In some examples, the gravitational sensor determines angular positions of a roller tube on which the covering is at least partially wound. In some examples, the gravitational sensors are used to determine if a manual input (e.g., a pull on the covering, operation of an device, etc.) is provided. In some instances, in response to the manual input, an example controller controls the motor to perform the action instructed by the input (e.g., to move the covering, stop movement of the covering, and/or counter the manual input to prevent lowering or raising the architectural opening covering past a threshold position such as, for example, a lower limit position or an upper limit position, etc.).

Although certain example methods, apparatus and articles of manufacture have been described herein, the scope of coverage of this patent is not limited thereto. On the contrary, this patent covers all methods, apparatus and articles of manufacture fairly falling within the scope of this patent.

What is claimed is:

1. An architectural covering assembly, comprising:

a tube;

a covering operatively coupled to the tube such that rotation of the tube extends or retracts the covering;

a motor operatively coupled to the tube to rotate the tube;

a gravitational sensor mounted to rotate with the tube, the gravitational sensor to measure a number of rotations of the tube and the gravitational sensor as the tube rotates to generate tube position information based on a gravity reference, the tube position information including: 1) first tube position information when the tube is rotated by the motor, and 2) second tube position information when the tube is rotated by a manual control without energizing the motor; and a controller communicatively coupled to the motor to control the motor, wherein the controller continually determines a current position of the covering using at least one of the first tube position information or the second tube position information when the tube is rotated by the motor, wherein the covering has a range of positions between a fully extended position and a fully retracted position.

2. The architectural covering assembly of claim 1, wherein the gravitational sensor is an accelerometer.

3. The architectural covering assembly of claim 1, wherein an axis of rotation of the gravitational sensor is substantially coaxial to an axis of rotation of the tube.

4. The architectural covering assembly of claim 1, wherein a center of the gravitational sensor is disposed on an axis of rotation of the tube.

5. The architectural covering assembly of claim 1, wherein the controller is structured to determine the current position of the covering based on an angular position of the tube as indicated in the tube position information.

6. The architectural covering assembly of claim 1, wherein the tube is rotated by the manual control that applies an external force different than the motor, the external force applied to a portion of the architectural covering assembly.

7. A tangible computer readable medium comprising instructions that, when executed, cause a machine to at least:

determine an angular position of a tube of an architectural covering assembly via a gravitational sensor, which fully rotates with the tube as the tube extends or retracts an architectural covering, the angular position being based on at least one of first tube position information obtained when the tube is rotated by a motor and second tube position information obtained when the tube is rotated by a manual control without energizing the motor, wherein rotation of the tube is to extend or retract the architectural covering, wherein the gravitational sensor is to measure rotation of the tube and the gravitational sensor to determine the angular position when the tube is rotated by the motor and when the tube is rotated by the manual control without energizing the motor, and wherein the angular position is determined based on a number of rotations of the tube, measured by the gravitational sensor, from a stored position of the tube; and when the tube is rotated by the motor, determine a position of the architectural covering between a fully extended position and a fully retracted position using at least one of the first tube position information or the second tube position information.

8. The computer readable medium of claim 7, wherein the stored position of the tube corresponds to a stored position of the architectural covering.

9. The computer readable medium of claim 8, wherein the stored position of the architectural covering is the fully extended position.

10. The computer readable medium of claim 7, wherein the instructions, when executed, further cause the machine to operate the motor to rotate the tube to move the architectural covering from a first position to a second position.

11. The computer readable medium of claim 7, wherein the instructions, when executed, further cause the machine to operate the motor to prevent rotation of the tube.

12. The computer readable medium of claim 7, wherein the instructions, when executed, further cause the machine to determine if rotation of the tube is influenced by the manual control provided to the architectural covering assembly, the manual control influencing the rotation without operation of the motor of the architectural covering assembly.

13. The computer readable medium of claim 12, wherein the instructions, when executed, further cause the machine to operate the motor in response to the manual control, the motor operatively coupled to the tube to rotate the tube.

14. The computer readable medium of claim 13, wherein the instructions, when executed, cause the machine to operate the motor to counter rotation of the tube caused by the manual control.

15. The computer readable medium of claim 13, wherein the instructions, when executed, cause the machine to operate the motor to stop rotation of the tube.

16. The computer readable medium of claim 13, wherein the instructions, when executed, cause the machine to operate the motor to move the covering to a set position.

17. The computer readable medium of claim 13, wherein the instructions, when executed, cause the machine to terminate operation of the motor.

18. The computer readable medium of claim 7, wherein the instructions, when executed, further cause the machine to set the position of the architectural covering.

19. The computer readable medium of claim 7, wherein the gravitational sensor is an accelerometer.

20. The computer readable medium of claim 7, wherein a center of the gravitational sensor is disposed on an axis of rotation of the tube.

21. A tangible computer readable medium comprising instructions that, when executed, cause a machine to at least:

operate a motor to rotate a tube of an architectural covering assembly, the architectural covering assembly including an architectural covering mounted on the tube such that rotation of the tube extends or retracts the architectural covering;

monitor movement of the tube via a gravitational sensor to continually track a current position of the tube, wherein the gravitational sensor rotates in complete revolutions with the tube as the tube extends or retracts the architectural covering, wherein the gravitational sensor is to monitor the movement of the tube and the gravitational sensor to determine first tube position information when the tube is rotated by the motor and second tube position information when the tube is rotated by a manual control without energizing the motor; and when the tube is rotated by the motor, determine an angular position of the tube at which the architectural covering is substantially fully extended using at least one of the first tube position information or the second tube position information.

22. The computer readable medium of claim 21, wherein the instructions, when executed, cause the machine to determine the angular position of the tube at which the architectural covering is substantially fully extended by detecting operation of the motor and detecting a lack of rotation of the tube.

23. The computer readable medium of claim 21, wherein the gravitational sensor is an accelerometer.

24. The computer readable medium of claim 21, wherein a center of the gravitational sensor is disposed on an axis of rotation of the tube.

25. The architectural covering assembly of claim 6, wherein the external force moves the architectural covering, the movement of the architectural covering causes rotation of the tube, and the controller is structured to detect that the movement causes a change in the tube position information indicated by the gravitational sensor.

26. The architectural covering assembly of claim 1, wherein the gravitational sensor is spaced from the motor, the gravitational sensor includes a first axis that is coaxial with a second axis of the tube.

27. An architectural covering assembly, comprising:

a tube;

a covering operatively coupled to the tube such that rotation of the tube moves the covering between an upper limit position and a lower limit position;

a motor operatively coupled to the tube to rotate the tube;

a gravitational sensor mounted to rotate with the tube, wherein the gravitational sensor is structured to measure rotation of the tube and the gravitational sensor to generate tube position information based on a gravity reference, and wherein each revolution of the gravitational sensor indicates a revolution of the tube; and a controller communicatively coupled to the motor to control the motor;

wherein:

the controller is communicatively coupled to the gravitational sensor to access the tube position information;

based on the tube position information, the controller determines a current position of the tube based on an amount of angular displacement of the tube relative to a stored angular position of the tube;

based on the tube position information, the controller determines a first rotational speed of the tube; and in response to the controller determining a difference between the first rotational speed and a second rotational speed of the motor, the controller identifies the tube as being rotated by a manual control and causes the motor to assist with moving the tube.

28. An architectural covering assembly, comprising:

a tube;

a covering operatively coupled to the tube such that rotation of the tube extends or retracts the covering to move the covering between an upper limit position and a lower limit position;

a motor operatively coupled to the tube to rotate the tube;

a gravitational sensor coupled to the tube, the gravitational sensor to rotate a number of revolutions with the tube as the tube rotates, wherein the gravitational sensor is structured to measure rotation of the tube and the gravitational sensor to generate tube position information based on a gravity reference; and a controller communicatively coupled to the motor to control the motor, the controller communicatively coupled to the gravitational sensor to enable access to the tube position information, the controller structured to:

determine a current position of the tube by counting a number of revolutions of the tube from a stored reference position based on the tube position information;

determine a rotational speed of the tube based on the tube position information;

determine whether the motor is causing the rotational speed of the tube; and in response to the motor not causing the rotational speed of the tube, cause the motor to assist with moving the tube.

29. The architectural covering assembly of claim 1, wherein the gravitational sensor is disposed inside the tube.

30. The architectural covering assembly of claim 1, further including:

a housing disposed within the tube to rotate with the tube; and a mount disposed in and coupled to the housing, the gravitational sensor fixed relative to the tube via the mount and the housing.

31. The computer readable medium of claim 7, wherein the gravitational sensor is disposed inside the tube.

32. The computer readable medium of claim 21, wherein the gravitational sensor is disposed inside the tube.

* * * * *